US008272615B2

(12) United States Patent
Silcox et al.

(10) Patent No.: US 8,272,615 B2
(45) Date of Patent: Sep. 25, 2012

(54) HUB WITH LOCKING MECHANISM

(75) Inventors: Paul S. Silcox, Wrentham, MA (US); Peter M. MacDonald, Sherborn, MA (US); Norman J. MacDonald, III, Lunenburg, MA (US)

(73) Assignee: Flexhead Industries, Inc., Harvey, IL (US)

( * ) Notice: Subject to any disclaimer, the term of this patent is extended or adjusted under 35 U.S.C. 154(b) by 310 days.

(21) Appl. No.: 12/784,286

(22) Filed: May 20, 2010

(65) Prior Publication Data

US 2011/0284098 A1 Nov. 24, 2011

(51) Int. Cl.
*B42F 13/00* (2006.01)

(52) U.S. Cl. ..... 248/342; 248/230.4; 248/231.515; 248/316.5; 248/200.1; 169/43; 169/41

(58) Field of Classification Search ..... 248/62, 248/72, 73, 75, 342, 343, 344, 230.4, 228.4, 248/231.51, 316.5, 229.23, 229.13, 317, 248/534, 229.2, 67.5, 200.1; 169/41, 51, 169/43, 16, 37

See application file for complete search history.

(56) References Cited

U.S. PATENT DOCUMENTS

| | | | | |
|---|---|---|---|---|
| 4,717,099 | A * | 1/1988 | Hubbard | 248/57 |
| 6,119,784 | A | 9/2000 | MacDonald et al. | |
| 6,123,154 | A | 9/2000 | MacDonald et al. | |
| 6,260,810 | B1 | 7/2001 | Choi | |
| 6,283,425 | B1 * | 9/2001 | Liljevik | 248/230.4 |
| 6,450,465 | B1 * | 9/2002 | Eslick | 248/230.4 |
| 6,488,097 | B1 | 12/2002 | MacDonald et al. | |
| 6,554,231 | B2 * | 4/2003 | Choi | 248/65 |
| D489,000 | S * | 4/2004 | Ellery | D8/396 |
| 6,752,218 | B2 | 6/2004 | MacDonald et al. | |
| 6,786,302 | B2 * | 9/2004 | Liew et al. | 182/186.8 |
| 6,843,394 | B2 * | 1/2005 | Aki | 224/309 |
| 7,032,680 | B2 | 4/2006 | MacDonald et al. | |
| 7,255,315 | B2 | 8/2007 | Oh | |
| 7,264,214 | B2 * | 9/2007 | Oh | 248/342 |
| 7,427,051 | B2 * | 9/2008 | Oh | 248/73 |
| 7,506,845 | B2 * | 3/2009 | Oh | 248/73 |
| 7,735,787 | B2 * | 6/2010 | Kafenshtok et al. | 248/75 |
| 7,784,746 | B2 * | 8/2010 | Kafenshtok et al. | 248/75 |
| 7,845,599 | B2 * | 12/2010 | Jackson | 248/73 |

(Continued)

FOREIGN PATENT DOCUMENTS

| | | |
|---|---|---|
| JP | 6-337082 | 12/1994 |
| JP | 9-196241 | 7/1997 |

OTHER PUBLICATIONS

Standard Specification for Nonstructural Steel Framing Members, ASTM International, Aug. 29, 2008.

(Continued)

*Primary Examiner* — Kimberly Wood

(57) ABSTRACT

A hub assembly for supporting a portion of a flexible sprinkler assemblage within a ceiling, the hub assembly including a primary support mounted to a ceiling support member, and a secondary support member rotatable relative to a primary support member between an open position and a closed position. In the closed position, portions of the supports are overlapping and cut outs formed in the primary support cooperate together with cut outs formed in the secondary support to define a hub opening configured to receive the portion of the flexible sprinkler assemblage. The hub assembly also includes a locking mechanism configured to selectively connect the primary support to the secondary support, and an adjustment mechanism disposed on the primary support that is configured to secure the position of the portion of the flexible sprinkler assemblage within the hub opening, and is separate from the locking mechanism.

50 Claims, 9 Drawing Sheets

U.S. PATENT DOCUMENTS

| | | | | |
|---|---|---|---|---|
| 7,878,464 | B2 * | 2/2011 | Oh | 248/65 |
| 7,954,771 | B2 * | 6/2011 | Paulig | 248/72 |
| 8,100,368 | B2 * | 1/2012 | Jackson et al. | 248/62 |
| 8,109,482 | B2 * | 2/2012 | Oh | 248/342 |
| 2007/0131823 | A1 * | 6/2007 | Mominee et al. | 248/62 |
| 2008/0099640 | A1 | 5/2008 | Kafenshtok | |
| 2011/0154755 | A1 * | 6/2011 | Oh | 52/220.8 |
| 2011/0215566 | A1 * | 9/2011 | Stempo et al. | 285/144.1 |

OTHER PUBLICATIONS

Standard Specification for the Manufacture, Performance, and Testing of Metal Suspension Systems for Acoustical Tile and lay-in Panel Ceilings, ASTM International, Oct. 2004.

Standard Practice for Installation of Metal Ceiling Suspension Systems for Acoustical Tile and Lay-in Panels, ASTM International, Jun. 10, 2004.

Standard Practice for Application for Ceiling Suspension Systems for Acoustical Tile and Lay-in Panels in Areas Requiring Seismic Restraint, ASTM International, May 31, 2006.

Standard Specification for Installation of Steel Framing Members to Receive Screw-Attached Gypsum Panel Products, ASTM International, Aug. 28, 2008.

* cited by examiner

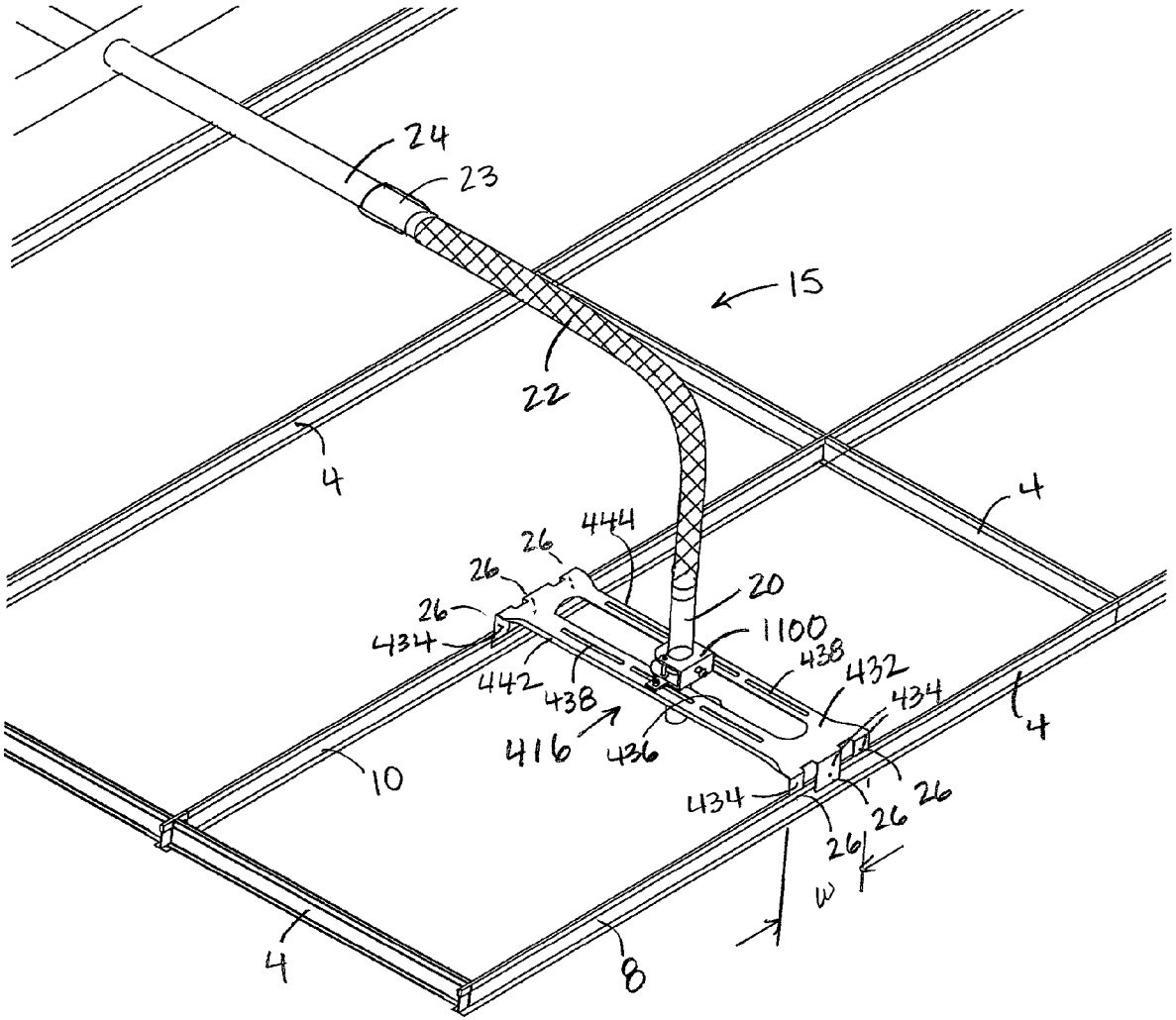
15
4
4
4
4
22
23
24
20
1100
438
434
432
434
26
26
26
26
26
26
26
26
444
438
434
434
438
434
434
434

HUB WITH LOCKING MECHANISM

The invention relates to hub assembly used in a fire protection sprinkler head support system.

BACKGROUND OF THE INVENTION

A typical automatic fire sprinkler system includes a network of pipes that carry a fire suppression fluid, e.g., water, to each room in a building. Conduit sections carry the fluid from the pipes to sprinkler heads strategically located in different rooms. The position and orientation of each sprinkler head is typically maintained in place by a support mechanism. When the room reaches an elevated temperature due to a fire, the sprinkler head is activated allowing a stream of fire suppression fluid to be directed over the intended area of coverage. During operation, the fluid pressure at the sprinkler head can reach as high as 175 psi, generating significant back pressure on the sprinkler head's support system. The support mechanism must be capable of holding the sprinkler head securely in place during operation.

SUMMARY

In one aspect, a hub assembly is provided that is configured to support a flexible fire sprinkler fitting within a ceiling, the ceiling comprising a ceiling support structure. The hub assembly includes a primary support configured to be mechanically coupled to the ceiling support structure and a secondary support member rotatable relative to the primary support member between an open position and a closed position.

The primary support includes a first plate, and a second plate extending generally parallel to and being spaced apart from the first plate. The first plate includes a first plate base edge and a first plate free edge opposed to the first plate base edge, the first plate free edge having an first plate cut out along the first plate free edge, the first plate cut out having a shape that corresponds to a portion of a profile defined by the fitting. The first plate also includes first plate lateral side edges that extend between the first plate base edge and the first plate free edge. The second plate includes a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out. The second plate also includes second plate lateral side edges that extend between the second plate base edge and the second plate free edge. The primary support also includes a primary base which extends between the first plate base edge and the second plate base edge.

The secondary support includes a third plate, and a fourth plate extending generally parallel to and being spaced apart from the third plate. The third plate a third plate base edge and a third plate free edge opposed to the third plate base edge, the third plate free edge having an third plate cut out along the third plate free edge, the third plate cut out having a shape that corresponds to a portion of a profile defined by the fitting. The third plate also includes third plate lateral side edges that extend between the third plate base edge and the third plate free edge. The fourth plate includes a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out. The fourth plate also includes fourth plate lateral side edges that extend between the fourth plate base edge and the fourth plate free edge. The secondary support further includes a secondary base which extends between the third plate base edge and the fourth plate base edge.

The secondary support is rotatably connected to the primary support so as to rotate between an open position and a closed position about a first axis, the first axis being generally perpendicular to the first plate and intersecting the first plate between one first plate lateral side edge and the first plate cut out.

The hub assembly further includes a locking mechanism configured to detachably secure the primary support to the secondary support and including a shaft received in shaft openings provided on one of the primary and secondary supports at a location between the corresponding other lateral side edges and cut outs. A key protrudes from the shaft in a direction generally perpendicular to the first plate. The locking mechanism further includes a catch configured to receive the key, the catch provided on the other of the primary and secondary supports at a location between the corresponding other lateral side edges and cut outs. The catch includes catch openings formed in the corresponding plates of the other of the primary and secondary supports, and a slot extending from each catch opening to the corresponding free edge. The slot is open along the corresponding free edge at a location between the corresponding other lateral side edges and cut outs. The slot has a slot dimension parallel to the corresponding free edge that is less than the catch opening dimension parallel to the corresponding free edge. The shaft is rotatable about a shaft axis parallel to the first axis between a first orientation in which the key can pass through the slot, and a second orientation in which the key is prevented from being passed through the slot, and when the shaft is rotated to the second orientation while the key is positioned in the catch opening, the key is prevented from being withdrawn from the catch. In addition, when the hub assembly is closed by positioning the key within the catch opening, the cut outs of the primary support cooperate together with the cut outs of the secondary support to define a hub opening configured to receive the fitting.

The hub assembly may include one or more of the following features: A bolt configured to secure the fitting within the hub assembly, the bolt being disposed in a bolt opening formed in the primary base. The key is rectangular, the key including a first key dimension transverse to the shaft axis that is less than the slot dimension, and a second key dimension transverse to both the first key dimension and the shaft axis, the second key dimension being greater than the slot dimension. The key is formed on a first end of the shaft so as to protrude along a longitudinal axis of the shaft, and a second key is formed on an opposed, second end of the shaft. A first end of the shaft is received in the shaft opening formed in one of the corresponding plates of the one of the primary and secondary supports, and a second end of the shaft is received in the shaft opening formed in the other of the corresponding plates of the one of the primary and secondary supports. At least one catch opening is defined by an inner edge, the inner edge including a protruding stop member. The first, second, third and fourth cut outs are configured to receive a flexible fire sprinkler fitting having a non-circular cross sectional shape. The first, second, third and fourth cut outs have a generally U shape. The first, second, third and fourth cut outs have a generally U shape including linear portions. The secondary support is rotatably connected to the primary support through a pin, the pin extending through the first, second, third and fourth plates. The ceiling support structure includes T-bar arranged to form a grid. The ceiling support structure includes parallel, spaced studs. The studs are formed of metal. The studs are formed of wood. The fitting is disposed within the hub opening.

The hub assembly may be included in a fire sprinkler support assembly. The support assembly supports a flexible fire sprinkler fitting within a ceiling structure comprising parallel, spaced beams, and includes a leg transverse to the beams, opposed ends of the leg connected to and supported on the beam via connection members. The hub assembly is supported on the leg.

The hub assembly may be included in a fire protection sprinkler system which includes the support system described above and a flexible sprinkler assemblage. The flexible sprinkler assemblage includes the flexible fire sprinkler fitting including a first end configured to connect to a flexible fluid supply line, and a second end configured to connect to a fire sprinkler head. The assemblage further includes a fire sprinkler head connected the second end, and a flexible fluid supply line connected to the first end, wherein a portion of the flexible fire sprinkler fitting is disposed in the hub opening. In some embodiments, the flexible fire sprinkler fitting has a circular cross sectional shape. In other embodiments, the flexible fire sprinkler fitting has a generally circular cross sectional shape that includes a linear portion.

In another aspect, a support assembly is provided that is configured to support a flexible fire sprinkler fitting within a ceiling structure comprising parallel, spaced beams, the support assembly including a leg transverse to the beams, opposed ends of the leg being connected to and supported by adjacent beams, and a hub assembly supported on the leg. The hub assembly includes a primary support configured to be mechanically coupled to the ceiling support structure and a secondary support member rotatable relative to the primary support member between an open position and a closed position.

The primary support includes a first plate, and a second plate extending generally parallel to and being spaced apart from the first plate. The first plate a first plate base edge and a first plate free edge opposed to the first plate base edge, the first plate free edge having an first plate cut out along the first plate free edge, the first plate cut out having a shape that corresponds to a portion of a profile defined by the fitting. The first plate also includes first plate lateral side edges that extend between the first plate base edge and the first plate free edge. The second plate includes a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out. The second plate also includes second plate lateral side edges that extend between the second plate base edge and the second plate free edge. The primary support further includes a primary base which extends between the first plate base edge and the second plate base edge, the first plate, the primary base and the second plate defining a space in which the leg is received.

The secondary support includes a third plate, and a fourth plate extending generally parallel to and being spaced apart from the third plate. The third plate includes a third plate base edge and a third plate free edge opposed to the third plate base edge, the third plate free edge having an third plate cut out along the third plate free edge, the third plate cut out having a shape that corresponds to a portion of a profile defined by the fitting. The third plate also includes third plate lateral side edges that extend between the third plate base edge and the third plate free edge. The fourth plate includes a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out. The fourth plate also includes fourth plate lateral side edges that extend between the fourth plate base edge and the fourth plate free edge. The secondary support further comprising a secondary base which extends between the third plate base edge and the fourth plate base edge.

The secondary support is rotatably connected to the primary support so as to rotate between an open position and a closed position about a first axis, the first axis being generally perpendicular to the first plate and intersecting the first plate between one first plate lateral side edge and the first plate cut out.

The hub assembly further includes a locking mechanism configured to detachably secure the primary support to the secondary support and including a shaft received in shaft openings provided on the primary support at a location between the corresponding other lateral side edges and cut outs. A key protrudes from the shaft in a direction generally perpendicular to the first plate. The locking mechanism further includes a catch configured to receive the key, the catch provided on the secondary support at a location between the corresponding other lateral side edges and cut outs, the catch including catch openings formed in the third and fourth plates, and a slot extending from each catch opening to the corresponding free edge, the slot being open along the corresponding free edge at a location between the corresponding other lateral side edges and cut outs. The slot has a slot dimension parallel to the corresponding free edge that is less than the catch opening dimension parallel to the corresponding free edge. The shaft rotatable about a shaft axis parallel to the first axis between a first orientation in which the key can pass through the slot, and a second orientation in which the key is prevented from being passed through the slot. When the shaft is rotated to the second orientation while the key is positioned in the catch opening, the key is prevented from being withdrawn from the catch. In addition, when the hub assembly is closed by positioning the key within the catch opening, the cut outs of the primary support cooperate together with the cut outs of the secondary support to define a hub opening configured to receive the fitting.

The support assembly may include one or more of the following features: The hub assembly may further include a bolt configured to adjustably position the hub assembly relative to the ceiling structure and to secure the fitting within the hub assembly. The bolt is disposed in a bolt opening formed in the primary base, and the position of the bolt within the bolt opening is adjustable by rotating the bolt. When the secondary support is closed such that the key is engaged by the catch and the fitting is disposed between the respective cutouts of primary and secondary supports, an end of the bolt urges the leg against the fitting to secure the fitting between the leg and the secondary support. The bolt is configured to permit adjustment of the position of the hub assembly relative to the leg in a two orthogonal directions that are parallel to the first plate. The key includes a first key dimension transverse to the shaft axis that is less than the slot dimension, and a second key dimension transverse to both the first key dimension and the shaft axis, the second key dimension being greater than the slot dimension. The key is formed on a first end of the shaft so as to protrude along a longitudinal axis of the shaft, and a second key is formed on an opposed, second end of the shaft. A first end of the shaft is received in the shaft opening formed in the first plate, and a second end of the shaft is received in the shaft opening formed in the second plate. At least one catch opening is defined by an edge, the edge including a protruding stop member. The first, second, third and fourth cut outs are configured to receive a flexible fire sprinkler fitting having a non-circular cross sectional shape. The first, second, third and fourth cut outs have a generally U shape. The first, second, third and fourth cut outs have a generally U shape including linear portions. The secondary support is rotatably connected to the primary support through a pin, the pin extending through the first, second third and fourth plates. The beams include T-bar arranged to form a grid. The beams include metal studs. The beams include wood studs. A portion of each of the first and second plates is received between a portion of the each of the third and fourth plates.

The support assembly may be included in a fire protection sprinkler system which also includes a flexible sprinkler assemblage.

In another aspect, a support assembly is provided that is configured to support a flexible fire sprinkler fitting within a ceiling structure comprising parallel, spaced beams. The support assembly includes a leg extending transverse to the beams, opposed ends of the leg being connected to and supported by adjacent beams, and a hub assembly supported on the leg. The hub assembly includes a primary support configured to be mechanically coupled to the ceiling support structure and a secondary support member rotatable relative to the primary support member between an open position and a closed position.

The primary support includes a first plate, and a second plate extending generally parallel to and being spaced apart from the first plate. The first plate includes a first plate base edge and a first plate free edge opposed to the first plate base edge, the first plate free edge having an first plate cut out along the first plate free edge, the first plate cut out having a shape that corresponds to a portion of a profile defined by the fitting. The first plate further includes first plate lateral side edges that extend between the first plate base edge and the first plate free edge. The second plate includes a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out. The second plate includes second plate lateral side edges that extend between the second plate base edge and the second plate free edge. The second plate lateral side edges further including protrusions extending outward beyond second plate lateral side edges in a plane parallel to the plane of the second plate, each protrusion including a through hole configured to receive a fastener for securing the second plate to the leg. The primary support further includes a primary base which extends between the first plate base edge and the second plate base edge.

The secondary support includes a third plate, and a fourth plate extending generally parallel to and being spaced apart from the third plate. The third plate includes a third plate base edge and a third plate free edge opposed to the third plate base edge, the third plate free edge having an third plate cut out along the third plate free edge, the third plate cut out having a shape that corresponds to a portion of a profile defined by the fitting. The third plate also includes third plate lateral side edges that extend between the third plate base edge and the third plate free edge. The fourth plate includes a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out. The fourth plate also includes fourth plate lateral side edges that extend between the fourth plate base edge and the fourth plate free edge. The secondary support further comprising a secondary base which extends between the third plate base edge and the fourth plate base edge.

The secondary support is rotatably connected to the primary support so as to rotate between an open position and a closed position about a first axis, the first axis being generally perpendicular to the first plate and intersecting the first plate between one first plate lateral side edge and the first plate cut out.

The hub assembly also includes a locking mechanism configured to detachably secure the primary support to the secondary support. The locking mechanism includes a shaft received in shaft openings provided on the secondary support at a location between the corresponding other lateral side edges and cut outs. A key protrudes from the shaft in a direction generally perpendicular to the first plate. The locking mechanism also includes a catch configured to receive the key, the catch provided on the primary support at a location between the corresponding other lateral side edges and cut outs, the catch including catch openings formed in the first and second plates, and a slot extending from each catch opening to the corresponding free edge. The slot is open along the corresponding free edge at a location between the corresponding other lateral edges and cut outs. The slot has a slot dimension parallel to the corresponding free edge that is less than the catch opening dimension parallel to the corresponding free edge. The shaft is rotatable about a shaft axis parallel to the first axis between a first orientation in which the key can pass through the slot, and a second orientation in which the key is prevented from being passed through the slot. When the shaft is rotated to the second orientation while the key is positioned in the catch opening, the key is prevented from being withdrawn from the catch, and when the hub assembly is closed by positioning the key within the catch opening, the cut outs of the primary support cooperate together with the cut outs of the secondary support to define a hub opening configured to receive the fire sprinkler fitting.

The support assembly may include one or more of the following features: The hub assembly may further include a bolt configured to secure the fitting within the hub assembly. The bolt is disposed in a bolt opening formed in the primary base, and the position of the bolt within the bolt opening is adjustable by rotating the bolt. When the secondary support is positioned relative to the primary support such that the key is engaged by the catch and the fitting is disposed between the respective cutouts of primary and secondary supports, an end of the bolt urges the fitting against the secondary support to secure the fitting within the hub assembly. The key is rectangular and includes a first key dimension transverse to the shaft axis that is less than the slot dimension, and a second key dimension transverse to both the first key dimension and the shaft axis, the second key dimension being greater than the slot dimension. The key is formed on a first end of the shaft so as to protrude along a longitudinal axis of the shaft, and a second key is formed on an opposed, second end of the shaft. A first end of the shaft is received in the shaft opening formed in the third plate, and a second end of the shaft is received in the shaft opening formed in the fourth plate. At least one catch opening is defined by an inner edge, the inner edge including a protruding stop member. The first, second, third and fourth cut outs are configured to receive a flexible fire sprinkler fitting having a circular cross sectional shape. The first, second, third and fourth cut outs have a generally U shape. The third and fourth cut outs have a serrated edge. The secondary support is rotatably connected to the primary support through a pin, the pin extending through the first, second third and fourth plates. The beams include T-bar arranged to form a grid. The beams include metal studs. The beams include wood studs. A portion of each of the third and fourth plates is received between a portion of each of the first and second plates.

The support system may be included in a fire protection sprinkler system that also includes a flexible sprinkler assemblage.

In another aspect, a method of operating a hub assembly for supporting a flexible sprinkler assemblage is disclosed. The hub assembly includes a secondary support member rotatable relative to a primary support member between an open position in which a free edge of the secondary support member is spaced apart from a free edge of the primary support member, and a closed position in which the respective free edges are overlapping and in which cut outs formed in the primary support cooperate together with cut outs formed in the secondary support to define a hub opening configured to receive a portion of the flexible sprinkler assemblage. The hub assembly includes a locking mechanism configured to selectively connect the free edges of the primary support to the free edges of the secondary support, and an adjustment mechanism disposed on the primary support that is configured to secure the position of the portion of the flexible sprinkler assemblage within the hub opening, and which is separate from the locking mechanism. Operation of the hub assembly includes the following method steps:

Providing the hub assembly such that the secondary support is in the open position relative to the primary support.

Inserting the portion of the flexible sprinkler assemblage within the cut outs formed in the primary support.

Rotating the secondary support to the closed position relative to the primary support such that the portion of the flexible sprinkler assemblage is disposed in the hub opening.

Actuating the locking mechanism to secure the secondary support to the primary support and retain the portion of the flexible sprinkler assemblage within the hub opening.

Actuating the adjustment mechanism to secure the position of the portion of the flexible sprinkler assemblage within the hub opening.

The method may include one or more of the following features: The flexible sprinkler assemblage includes a sprinkler head fitting including a first end configured to connect to a fluid supply line, and a second end configured to connect to a fire sprinkler head. The assemblage further includes a fire sprinkler head connected the second end, and a flexible fluid conduit connected to the first end, and the inserting step includes inserting the sprinkler head fitting within the first cut outs formed in the primary support. The method step of actuating the locking mechanism precedes the method step of actuating the adjustment mechanism. The adjustment mechanism includes an adjustment bolt configured to secure the portion of the flexible sprinkler assemblage within the hub assembly, the bolt disposed in a bolt opening formed in the primary base, and the method further includes adjusting the adjustment bolt by rotation of the bolt with in the opening so as to urge the portion of the flexible sprinkler assemblage against the secondary support.

As discussed above, the hub assembly includes a secondary support member rotatable relative to a primary support member between an open position in which a free edge of the secondary support member is spaced apart from a free edge of the primary support member, and a closed position in which the respective free edges are overlapping. When the hub assembly is closed, cut outs formed in the primary support cooperate together with cut outs formed in the secondary support to define a hub opening configured to receive a fire sprinkler head fitting. Because the hub assembly can be opened, a sprinkler head fitting that has been preassembled with the sprinkler head and flexible supply line can be easily installed in the hub opening. Once the sprinkler head fitting, including sprinkler head, and flexible supply line attached thereto, is received within the hub assembly, the hub assembly is closed and locked. Because the sprinkler head fitting can be pre-assembled with the sprinkler head and flexible supply line, it can be pre-charged with water and tested prior to mounting within the ceiling. Moreover, it can then loaded into the open hub assembly in the assembled state, in either a charged or uncharged condition. This feature also creates more flexibility in the construction process timelines, since the sprinkler system can be assembled and tested independently of ceiling construction.

Once the fire sprinkler head fitting is received within the hub assembly, and the secondary support is closed against the primary support, the primary and secondary supports are maintained in the closed position using a locking mechanism. The locking mechanism is disposed in the vicinity of the overlapping free edges, and includes shaped openings formed in one of the supports, and a key provided on the other of the supports. The key is rotatable between a first position in which it is engaged with the shaped openings, and a second position in which it can be released from the shaped openings. A key rotation of about one quarter turn is sufficient to move from the first to second positions. Thus, locking of the secondary support to the primary support is quickly and easily achieved through a turn of the key.

In addition, the hub assembly includes an adjustment mechanism independent of the locking mechanism that permits adjustment of the position of the fire sprinkler head fitting within the hub opening, and securement of the sprinkler head fitting within the hub opening once the sprinkler head fitting is in the desired position. The adjustment mechanism also secures the locking mechanism key in the locked position. The adjustment mechanism is disposed on a base portion of the primary support at a location distant from the locking mechanism, and includes an adjustment bolt disposed in an opening formed in the base portion. By providing an adjustment mechanism separate from the locking mechanism, adjustment of the position of the sprinkler head fitting within the hub opening can be achieved without having to release the locking mechanism, whereby assembly and positioning of the sprinkler head fitting within the hub assembly is simplified.

Modes for carrying out the present invention are explained below by reference to an embodiment of the present invention shown in the attached drawings. The above-mentioned object, other objects, characteristics and advantages of the present invention will become apparent from the detailed description of the embodiment of the invention presented below in conjunction with the attached drawings.

BRIEF DESCRIPTION OF THE DRAWINGS

FIG. 8 is a perspective view of an alternative hub assembly disposed on a sprinkler support assembly within a suspended ceiling.

DETAILED DESCRIPTION

Figure 1:
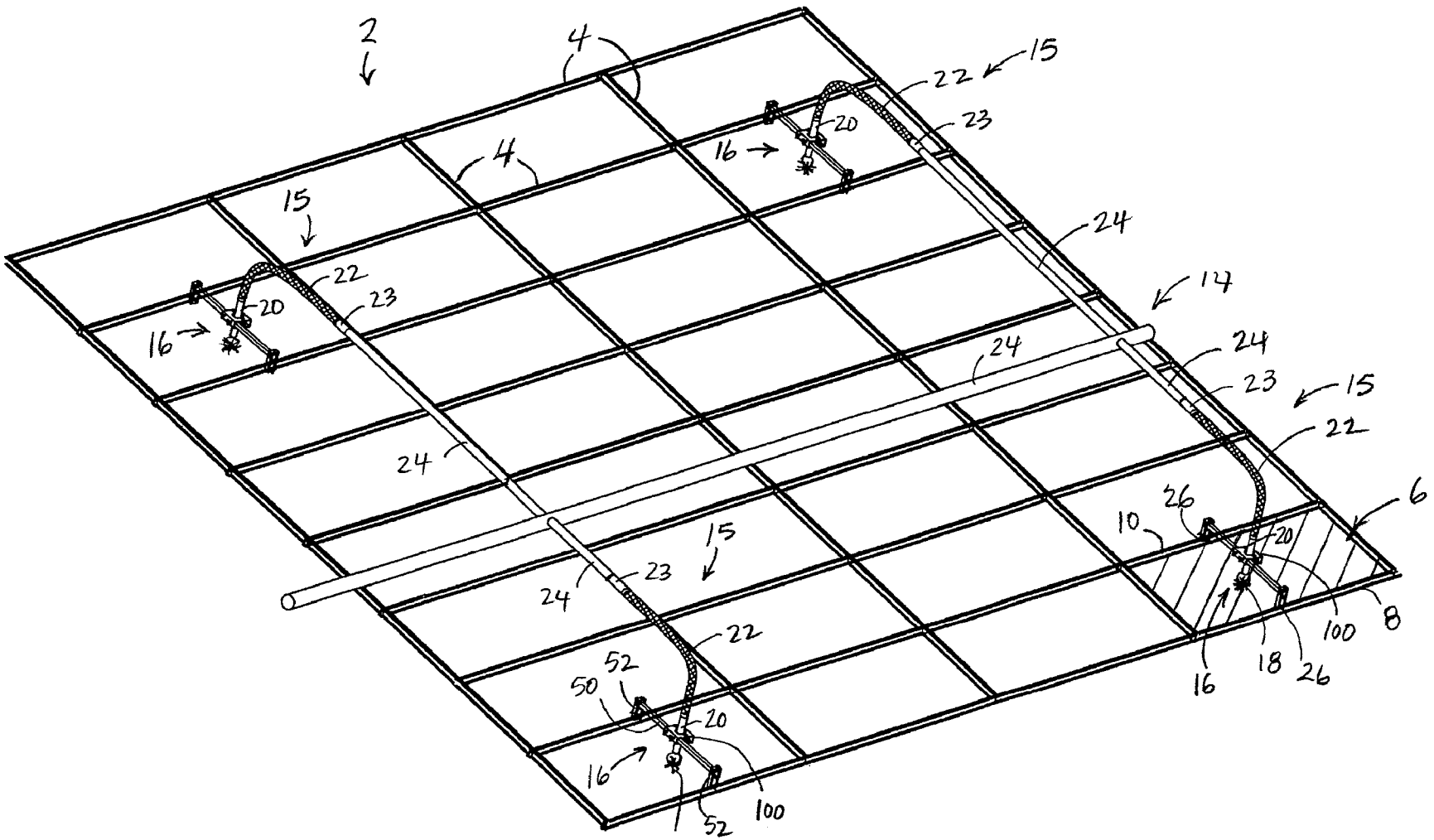
FIG. 1 is a diagrammatic, perspective view of hub assemblies disposed on sprinkler support assemblies positioned within a suspended ceiling.

With reference to FIG. 1, a sprinkler system 14 includes several sprinkler support assemblies 16 mounted within a ceiling 2 having a ceiling frame 4 formed of an array of rectangular frame sections 6 (one frame section 6 is shown with cross hatch). Ceiling frame 4 can be a suspended ceiling for supporting a decorative panel (not shown) within each rectangular frame section 6. For example, the ceiling frame 4 may consist of T-bar suspended from an overlying building structure using, for example, flexible wire, and may be configured according to ASTM International standards. The standards may include, but are not limited to, those set forth in one or more of designations C635-04, C636-04 and E580-02, which are each incorporated herein by reference. In order to protect the room from fire, the sprinkler system 14 is most commonly located above the ceiling frame 4, but can also reside in a floor or in one or more walls.

The fire sprinkler system 14 can include supply pipes 24 as part of a fire suppression fluid delivery system. The fluid delivery system can be dedicated to fire suppression, or can also deliver water to other functions (e.g., within the building). The fire sprinkler system 14 also includes a flexible sprinkler assemblage 15 that carries the fire suppression fluid, e.g. water, from the supply pipes 24 to the sprinkler head 18. For example, the flexible sprinkler assemblage 15 can include an inlet fitting 23 which connects the assemblage 15 to a supply pipe 24, and a flexible conduit 22 which extends between the inlet fitting 23 and one end of a rigid sprinkler head fitting 20. The assemblage 15 can further include the sprinkler head 18 which is connected to another end of the sprinkler head fitting 20. When the room reaches elevated temperatures, sprinkler head 18 is activated and a stream of fire suppression fluid is directed into the room to extinguish the fire.

As will be described in greater detail below, each sprinkler support assembly 16 secures a sprinkler head 18 at a predetermined position within an associated one of rectangular frame sections 6. In order to function effectively, sprinkler head 18 must be held firmly in place during operation. Due to the significant back pressure of the fluid flowing therethrough, sprinkler head 18 is subjected to tremendous side, rotational, and torsional forces, which are capable of changing the position of the sprinkler head 18, thereby causing the fluid to be directed away from the intended target. The sprinkler support assembly 16 is configured to resist movement of sprinkler head 18 by distributing the forces to spaced-apart points 26 along the periphery of one of the rectangular frame sections 6.

Figure 2:
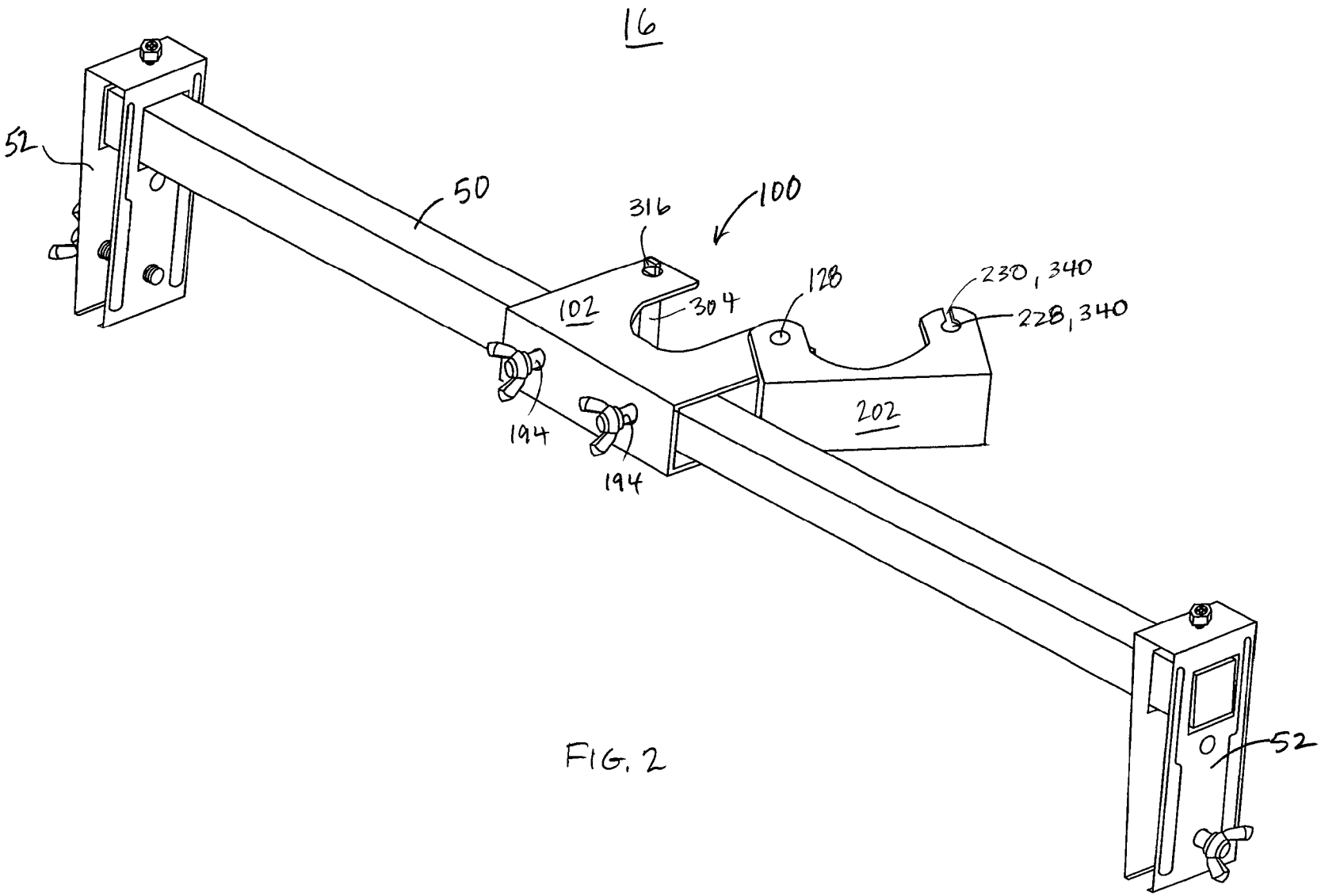
FIG. 2 is a perspective view of one of the hub assemblies of FIG. 1 disposed on a sprinkler support assembly, with the hub assembly in an open configuration.

Referring also to FIG. 2, the sprinkler support assembly 16 includes a hub assembly 100 and a leg 50 that connects the hub assembly 100 to the ceiling frame 4. The leg 50 is configured to resist the forces imparted to sprinkler head 18 during its operation. In particular, the hub assembly 100 is supported within the frame section 6 by the leg 50 which extends across the rectangular frame section 6 from one frame side 8 to an opposite and parallel frame side 10. Opposed ends of the leg 50 include clips 52 through which the leg is supported above the frame sides 8, 10. Each clip 52 is bifurcated, straddles the corresponding frame side, and is fixed thereto, for example using a bolt 54 which passes through the clip 52 to clamp the clip 52 to the T-bar.

Referring to FIGS. 3-7, the hub assembly 100 includes a primary support 102 which mounts on the leg 50, and a secondary support 202 that is rotatably connected to the primary support 102. The primary support 102 and secondary support 202 have complimentary shapes so that when the secondary support 202 is in a closed position relative to the primary support 102, these structures define a hub opening 350 configured to receive and securely retain a portion of the fire sprinkler assemblage 15, for example the sprinkler head fitting 20, as discussed in detail below.

When viewed in cross section, the primary support 102 is a rigid, generally U-shaped member, and includes a first plate 110, a second plate 140 extending generally parallel to and being spaced apart from the first plate 110, and a primary base 180 which connects the first and second plates 110, 140. The first plate 110, the primary base 180 and the second plate 140 are arranged to define a space 136 in which the leg 50 is received, and the distance between the first plate and second plate corresponds the thickness of the leg 50.

In particular, the first plate 110 includes a base edge 112, a free edge 114 opposed to the base edge 112, and a pair of opposed lateral side edges 116, 118 extending between the free edge 114 and the base edge 112. The first plate 110 is formed having a first cut out 120 along the free edge 114, such that the distance of the free edge 114 from the base edge 112 in a central region of the first plate 110 is much less that the distance of the free edge 114 from the base edge 114 adjacent the lateral side edges 116, 118. The first cut out 120 is arcuate, forming a generally U-shape that corresponds to a portion of the profile defined by the sprinkler head fitting 20 received within the hub assembly 100.

The second plate 140 is substantially the same shape as the first plate 110, and includes a base edge 142, a free edge 144 opposed to the base edge 142, and a pair of opposed lateral side edges 146, 148 extending between the free edge 144 and the base edge 142. The second plate 140 is formed having a second cut out 150 along the free edge 144. The size and shape of the second cut out 150 is substantially the same as that of the first cut out 120, and the first and second cut outs 120, 150 are aligned along an axis perpendicular to the planes defined by the first and second plates 110, 140.

The primary base 180 extends between the first plate base edge 112 and the second plate base edge 142 so as to be generally perpendicular to both the first and second plates 110, 140. The primary base 180 includes at least one through hole 190, and in the illustrated embodiment includes a pair of mutually spaced through holes 190, 192. Adjustment bolts 194, disposed within the through holes 190, 192, include threads which engage threads formed on inner surfaces of the through holes 190, 192. The adjustment bolts 194 cooperate with the primary base 180 to permit adjustment of the hub assembly relative to the leg 50, and to secure the sprinkler head fitting 20 within the hub assembly 100, as discussed in detail below.

The secondary support 202 is generally a mirror image of the primary support 102, with differences between the secondary support 202 and the primary support 102 made clear in the following description. When viewed in cross section, the secondary support 202 is a rigid, generally U-shaped member, and includes a third plate 210, a fourth plate 240 extending generally parallel to and being spaced apart from the third plate 210, and a secondary base 280 which connects the third and fourth plates 210, 240. The third plate 210, the secondary base 280 and the fourth plate 240 are arranged to define a space 236 therein. The distance between the third plate 210 and the fourth plate 240 corresponds the overall thickness of the primary support 102.

In particular, the third plate 210 includes a base edge 212, a free edge 214 opposed to the base edge 212, and a pair of opposed lateral side edges 216, 218 extending between the free edge 214 and the base edge 212. The third plate 210 is formed having a third cut out 220 along the free edge 214, such that the distance of the free edge 214 from the base edge 212 in a central region of the third plate 210 is much less that the distance of the free edge 214 from the base edge 212 adjacent the lateral side edges 216, 218. The cut out 220 is arcuate, forming a generally U-shape that corresponds to a portion of the profile defined by the sprinkler head fitting 20 received within the hub assembly 100.

The fourth plate 240 is substantially the same shape as the third plate 210, and includes a base edge 242, a free edge 244 opposed to the base edge 242, and a pair of opposed lateral side edges 246, 248 extending between the free edge 244 and the base edge 242. The fourth plate 240 is formed having a fourth cut out 250 along the free edge 244. The size and shape of the fourth cut out 250 is substantially the same as that of the third cut out 220, and the third and fourth cut outs 220, 250 are aligned along an axis perpendicular to the planes defined by the third and fourth plates 210, 240.

The secondary base 280 extends between the third plate base edge 212 and the fourth plate base edge 242 so as to be generally perpendicular to both the third and fourth plates 210, 240.

The overall dimension of the primary support 102 is greater than that of the secondary support 202 in a direction transverse to the respective base edges 112, 142, 212, 242. That is, the distances of the free edges 214, 244 from the respective base edges 212, 242 of the third and fourth plates 210, 240 along one lateral side edge 216, 246 is less than the distances of the free edges 114, 144 from the respective base edges 112, 142 of the first and second plates 110, 140 along one lateral side edge 116, 146.

Figure 3:
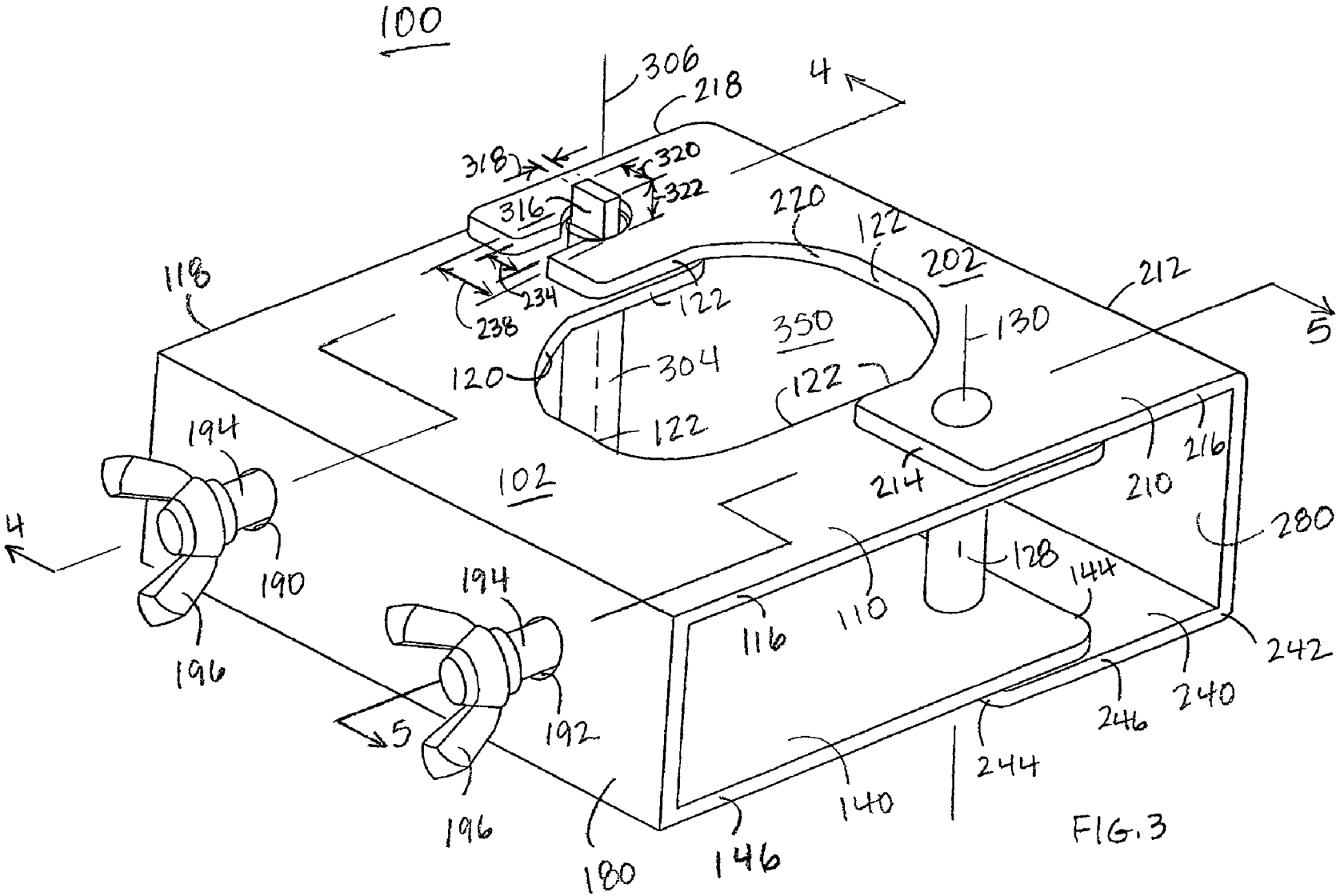
FIG. 3 is a perspective view of the hub assembly of FIG. 2 in a closed configuration.
Figure 5:
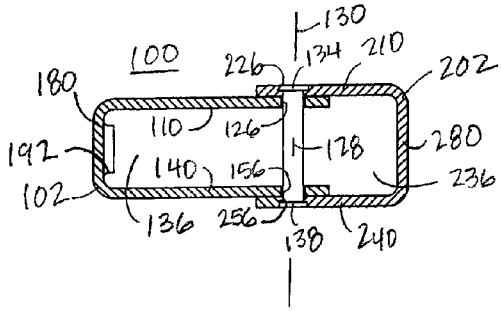
FIG. 5 is a side sectional view of the hub assembly of FIG. 2 across line 5-5 of FIG. 3.
Figure 7:
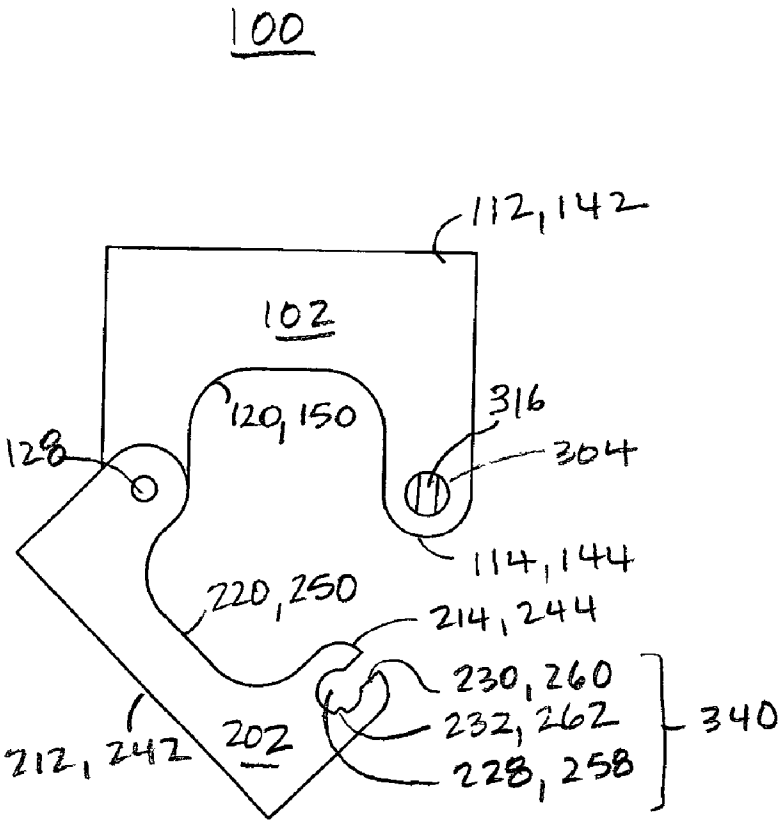
FIG. 7 is a top view of the hub assembly of FIG. 2 in the open configuration.
Figure 6:
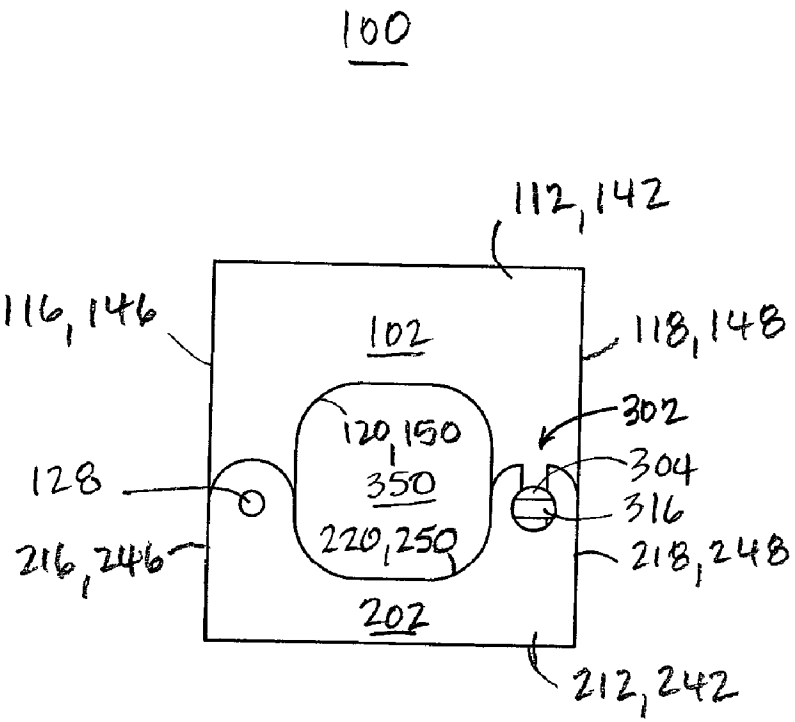
FIG. 6 is a top view of the hub assembly of FIG. 2 in the closed configuration.

Referring to FIGS. 3 and 5, the secondary support 202 is rotatably connected to the primary support 102 so as to rotate about a pin 128 between an open position (FIGS. 2, 7) and a closed position (FIGS. 1, 3, 6). Portions of the free edges 114, 144 of the first and second plate 110, 140 are received in the space 236 between the third and fourth plates 210, 240 so that portions of the secondary support 202 overlap portions of the primary support 102 adjacent to respective free edges. A first end 134 of the pin 128 is supported in an opening 226 provided in the third plate 210 at a location between a third plate first lateral side edge 216 and the third cut out 220. An opposed second end 138 of the pin 128 is supported in an opening 256 provided in the fourth plate 240 at a location between the fourth plate first lateral side edge 246 and the fourth cut out 250. The pin 128 passes through corresponding openings 126, 156 formed in the first plate 110 and second plate 240 between respective first and second plate cut outs 120, 150 and respective first lateral side edges 116, 146. The pin 128 rotates about a pin longitudinal axis 130 that is generally perpendicular to the first and third plates 110, 210. The openings 226, 256 formed in the third and fourth plates 210, 240 are beveled, and the pin 128 is maintained within the hub assembly 100 by providing opposed pin ends 134, 138 with corresponding bevels which engage the openings 226, 256.

Figure 4:
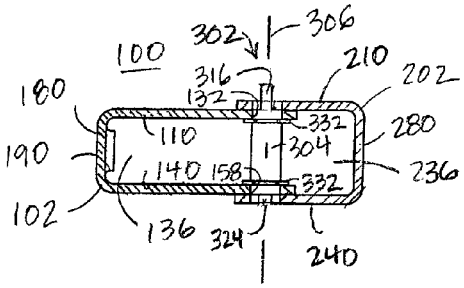
FIG. 4 is a side sectional view of the hub assembly of FIG. 2 across line 4-4 of FIG. 3.

Referring to FIGS. 3 and 4, the hub assembly 100 includes a locking mechanism 302 configured to detachably secure the primary support 102 to the secondary support 202. The locking mechanism includes a cylindrical locking shaft 304 that is rotatably supported by the primary support 102. More particularly, a first end 308 of the shaft 304 is supported in an opening 132 provided in the first plate 110 at a location between a first plate second lateral side edge 118 and the first cut out 120. An opposed second end 310 of the shaft 304 is supported in an opening 158 provided in the second plate 140 at a location between the second plate second lateral side edge 148 and the second cut out 150. The shaft 304 rotates relative to the first and second plates 110, 140 about its longitudinal axis 306, which is generally perpendicular to the first and third plates 110, 210. The shaft 304 is retained within openings 132, 158 using e-clips 332 adjacent the openings 132, 158.

The shaft 304 is provided with a first key 316 protruding from the first end 380, and a second key 324 protruding from the second end 310. The keys 316, 234 are generally rectangular, and protrude in a direction parallel to the shaft axis 306.

Each key 316, 324 includes a first key dimension 318 transverse to the shaft axis 306 that is less than the outer diameter of the shaft 304, and a second key dimension 320 transverse to both the first key dimension and the shaft axis 306, the second key dimension 320 corresponding to the diameter of the shaft 304. Each key 316, 324 includes a third key dimension 322 corresponding to its axial length, and the first key 316 has an axial length which is longer than that of the second key 324. As seen in FIG. 4, the first key 316 extends upward beyond the outer surface of the third plate 210 to permit manual rotation of the shaft 304 within the hub assembly 100. The second key 324, however, extends only to the outer surface of the fourth plate 240.

The locking mechanism also includes a catch 340 configured to receive the key. The catch 340 is provided on the secondary support 202 at a location which corresponds to the location of the shaft 304 on the primary support 102. That is, the catch 340 includes a third plate catch opening 228 provided in the third plate 210 at a location between the third plate second lateral side edge 218 and the third plate cut out 220, and a fourth plate catch opening 258 provided in the fourth plate 240 at a location between the fourth plate second lateral side edge 248 and the fourth cut out 250. Each catch opening 228, 258 is a generally circular opening disposed adjacent to and spaced apart from the corresponding free edge 214, 244. A slot 230, 260 extends between each catch opening 228, 258 and the corresponding free edge 214, 244. Each slot 230, 260 is open along the corresponding free edge 214, 244, and has a slot dimension 234 parallel to the corresponding free edge 213, 244 that is less than the catch opening dimension 238 parallel to the corresponding free edge 214, 244. Each slot 230, 260 provides a passage through which the keys 316, 234 may pass into the respective catch openings 228, 258 as the secondary support 202 rotates to the closed position.

The respective first dimensions 318 of each key 316, 324 are less than the slot dimension 234 and the respective second dimensions 320 of each key 316, 324 are greater than the slot dimension. In use, the shaft 304 is freely rotatable about the shaft axis 306, and thus can be oriented in a first position (FIG. 7) in which the keys 316, 324 can pass through the respective slots 230, 260, and in a second position (FIG. 6) in which the keys 316, 324 are prevented from being passed through the respective slots 230, 260. Since the orientation corresponding to the first position is transverse to the orientation corresponding to the second position, a quarter turn of the key (e.g. rotation through a 90 degree angle) is sufficient to move between first and second positions. In some embodiments, the edge of each catch opening 228, 258 is provided with an inward protrusion 232, 262 which serves as a stop. The protrusions 232, 262 are positioned so that when the keys 316, 324 abut the protrusions 232, 262, the shaft 304 is oriented in the second position.

When the hub assembly 100 is closed by rotating the secondary support about the pin 128 to position the keys 316, 324 within the corresponding catch openings 228, 258, the cut outs 120, 150 of the primary support 102 cooperate together with the cut outs 220, 250 of the secondary support 202 to define a hub opening 350 configured to receive a portion of the fire sprinkler assemblage 15, for example the sprinkler head fitting 20. For example, to accommodate a generally cylindrical sprinkler head fitting 20 which includes flat portions (not shown) formed on the sides thereof, the respective arcuate cut outs 120, 150, 220, 250 include corresponding linear portions 122. When the sprinkler head fitting 20 including flat portions is received within the hub opening 350, rotation of the sprinkler head fitting 20 within the hub assembly 100 is prevented due to the engagement of the sprinkler head fitting flat portions with the linear portions 122.

Independently of retaining the sprinkler head fitting 20 within the hub opening 350 by closing the secondary support and turning the locking shaft keys 316, 324 to the second position, the adjustment bolts 194 are used to secure the position of the sprinkler head fitting 20 within the hub opening 350. In particular, when the leg 50 is disposed within the space 136, the adjustment bolts 194 are positioned within the through holes 190, 192 of the primary base 180 so that an end of each bolt 194 abuts a surface of the leg 50. The axial position of the bolts 194 relative to the primary base 180 (and thus also the leg 50) can be adjusted by rotation of the bolts 194. In this manner, the position of the hub assembly 100 relative to the leg 50 in a direction transverse to a longitudinal axis of the leg 50 can be adjusted. Moreover, when the sprinkler head fitting 20 is received within the hub opening 350, further inward adjustment of the bolts 194 urges the leg 50 against the sprinkler head fitting 20, which in turn is urged against the secondary support 202. Sufficient rotation of the bolts 194 serves to secure the fitting within the hub assembly 100. Doing so also urges the keys 316, 324 to abut edge surfaces of the corresponding catch openings 228, 258, preventing rotation of the shaft 304 about the shaft axis 306, effectively preventing inadvertent release of the secondary support 202 from the primary support 102. On the other hand, sufficient reverse rotation of the bolts 194 releases the leg 50 and sprinkler head fitting 20, permits opening of the hub assembly 100, and adjustment of the position of the hub assembly 100 relative to the leg 50 in a direction parallel to the longitudinal axis of the leg 50.

Referring to FIG. 8, an alternative sprinkler support assembly 416 is provided which includes a hub assembly 1100 and a leg 432 which connects the hub assembly 1100 to the ceiling frame 4.

The sprinkler support assembly 416 is configured to resist the forces imparted to sprinkler head 18 during its operation. The leg 432 is a relatively wide member that extends across the rectangular frame section 6 between parallel frame sides 8, 10, and thus lies generally parallel to the ceiling 2. The leg 432 includes clip portions 434 which connect the leg 432 to the respective frame sides 8, 10. For example, the clip portions 434 may be fixed to the frame sides 8, 10 using screws. The leg 432, including the clip portions 434, is provided with a width w that ensures that the forces on the support assembly 416 during sprinkler head operation are distributed to several points 26 along a portion each of the frame sides 8, 10. As a result, stability of the support assembly 416 is ensured and the sprinkler head 18 is prevented from moving or rotating in any direction during operation.

The leg 432 includes a central slot 436 that is sized to receive the sprinkler head fitting 20, and is elongated in a direction transverse to the width of the bracket to permit adjustment of the position of the sprinkler head fitting 20 within of the frame section 6. For example, the central slot 436 extends substantially from one frame side 8 to the other 10. The leg 432 also includes lateral slots 438 sized to receive a mounting screw 440. The lateral slots 438 are disposed between the central slot and lateral sides 442, 444 of the leg 432, and are elongated in a direction transverse to the width of the leg 432 to permit adjustment of the location of the screws within the leg 432.

Referring to FIGS. 9-13, an alternative embodiment hub assembly 1100 is shown that includes a primary support 1102 which mounts on the leg 432 of the support assembly 416, and a secondary support 1202 that is rotatably connected to the primary support 1102, as discussed in detail below. Like the first embodiment, the primary support 1102 and secondary support 1202 have complimentary shapes so that when the secondary support 1202 is in a closed position relative to the primary support 1102, these structures define a hub opening 350 configured to receive and securely retain the sprinkler head fitting 20, as discussed in detail below When viewed in cross section, the primary support 1102 is a rigid, generally U-shaped member, and includes a first plate 1110, a second plate 1140 extending generally parallel to and being spaced apart from the first plate 1110, and a primary base 1180 which connects the first and second plates 1110, 1140. The first plate 1110, the primary base 1180 and the second plate 1140 are arranged to define a space 1136. The distance between the first plate 1110 and the second plate 1140 corresponds the height (vertical dimension) of the secondary support 1202.

In particular, the first plate 1110 includes a base edge 1112, a free edge 1114 opposed to the base edge 1112, and a pair of opposed lateral side edges 1116, 1118 extending between the free edge 1114 and the base edge 1112. The first plate 1110 is formed having a first cut out 1120 along the free edge 1114, such that the distance of the free edge 1114 from the base edge 1112 in a central region of the first plate 1110 is much less that the distance of the free edge 1114 from the base edge 1114 adjacent the lateral side edges 1116, 1118. The cut out 1120 is arcuate, forming a generally U-shape that corresponds the profile defined by the sprinkler head fitting 20 received within the hub assembly 1100.

The second plate 1140 is substantially the same shape as the first plate 1110, and includes a base edge 1142, a free edge 1144 opposed to the base edge 1142, and a pair of opposed lateral side edges 1146, 1148 extending between the free edge 1144 and the base edge 1142. The second plate 1140 is formed having a second cut out 1150 along the free edge 1144. The size and shape of the second cut out 1150 is substantially the same as that of the first cut out 1120, and the first and second cut outs 1120, 1150 are aligned along an axis perpendicular to the planes defined by the first and second plates 1110, 1140. In addition, each of the second plate lateral side edges 1146, 1148 include protrusions 1160 extending laterally outward in a plane parallel to the plane of the second plate 1140. Each protrusion 1160 includes a through hole 1164 configured to receive a fastener. The protrusions are configured so that when the hub assembly is disposed on the leg 432, the respective through holes 1164 are vertically aligned with the lateral slots 438 of the leg 432. Fasteners received within the through holes 1146 and lateral slots 438 secure the second plate 1140, and thus the hub assembly 1100 to the leg 432.

The primary base 1180 extends between the first plate base edge 1112 and the second plate base edge 1142 so as to be generally perpendicular to both the first and second plates 1110, 1140. The primary base 1180 includes a through hole 1190. An adjustment bolt 1194, disposed within the through hole 1190, includes threads which engage threads formed on an inner surfaces of the through hole 1190. The adjustment bolt 1194 cooperates with the primary base 1180 to secure the sprinkler head fitting 20 within the hub assembly 1100, as discussed in detail below.

The secondary support 1202 is generally a mirror image of the primary support 1102, with differences between the secondary support 1202 from the primary support 1102 made clear in the following description. When viewed in cross section, the secondary support 1202 is a rigid, generally U-shaped member, and includes a third plate 1210, a fourth plate 1240 extending generally parallel to and being spaced apart from the third plate 1210, and a secondary base 1280 which connects the third and fourth plates 1210, 1240. The third plate 1210, the secondary base 1280 and the fourth plate 1240 are arranged to define a space 1236 therein. The distance between the third plate 1210 and the fourth plate 1240 is set so that portions of the secondary support 1202 can be received within the space 1136 within the primary support 1102.

In particular, the third plate 1210 includes a base edge 1212, a free edge 1214 opposed to the base edge 1212, and a pair of opposed lateral side edges 1216, 1218 extending between the free edge 1214 and the base edge 1212. The third plate 1210 is formed having a third cut out 1220 along the free edge 1214, such that the distance of the free edge 1214 from the base edge 1212 in a central region of the third plate 1210 is much less that the distance of the free edge 1214 from the base edge 1212 adjacent the lateral side edges 1216, 1218. The cut out 1220 is arcuate, forming a generally U-shape that corresponds to a portion of the profile defined by the sprinkler head fitting 20 received within the hub assembly 1100. The third cut out 1120 of this embodiment differs from the third cut out 220 of the first embodiment in that it is formed having a serrated, or toothed, edge.

The fourth plate 1240 is substantially the same shape as the third plate 1210, and includes a base edge 1242, a free edge 1244 opposed to the base edge 1242, and a pair of opposed lateral side edges 1246, 1248 extending between the free edge 1244 and the base edge 1242. The fourth plate 1240 is formed having a fourth cut out 1250 along the free edge 1244. The third and fourth cut outs 1220, 1250 are aligned along an axis perpendicular to the planes defined by the third and fourth plates 1210, 1240, and the size and shape of the fourth cut out 1250 is substantially the same as that of the third cut out 1220, whereby it is formed having a serrated, or toothed edge. This feature is advantageous for use with a cylindrical sprinkler head fitting 20 formed without flat side portions, for example having a circular cross sectional shape. By providing the third and fourth cut outs 1120, 1250 with a toothed edge, when the sprinkler head fitting 20 is disposed within the closed hub assembly 1100, the secondary support bites into the fitting sidewall, ensuring secure engagement with the sidewall and preventing relative movement between the sprinkler head fitting 20 and the hub assembly 1100.

The secondary base 1280 extends between the third plate base edge 1212 and the fourth plate base edge 1242 so as to be generally perpendicular to both the third and fourth plates 1210, 1240.

The overall dimension of the primary support 1102 is greater than that of the secondary support 1202 in a direction transverse to the respective base edges 1112, 1142, 1212, 1242. That is, the distances of the free edges 1214, 1244 from the respective base edges 1212, 1242 of the third and fourth plates 1210, 1240 along one lateral side edge 1216, 1246 is less than the distances of the free edges 1114, 1144 from the respective base edges 1112, 1142 of the first and second plates 1110, 1140 along one lateral side edge 1116, 1146.

Like the first embodiment hub assembly 100, hub assembly 1100 can be selectively opened and closed. In particular, the secondary support 1202 is rotatably connected to the primary support 1102 so as to rotate about a pin 128 between an open position (FIG. 9) and a closed position (FIG. 8). Portions of the free edges 1214, 1244 of the third and fourth plates 1210, 1240 are received in the space 1136 between the first and second plates 1110, 1140 so that portions of the primary support 1102 overlap portions of the secondary support 1202 adjacent to the respective free edges. A first end 134 of the pin 128 is supported in an opening 1226 provided in the third plate 1210 at a location between a third plate first lateral side edge 1216 and the third cut out 1220. The opposed second end 138 of the pin 128 is supported in an opening 1256 provided in the fourth plate 1240 at a location between the fourth plate first lateral side edge 1246 and the fourth cut out 1250. The pin 128 passes through corresponding openings 1126, 1156 formed in the first plate 1110 and second plate 1240 between respective first and second plate cut outs 1120, 1150 and respective first lateral side edges 1116, 1146. In a manner substantially the same as the first embodiment, the pin 128 is secured within the hub assembly 1100, and rotates about the pin axis 130 that is generally perpendicular to the first and third plates 1110, 1210.

Figure 9:
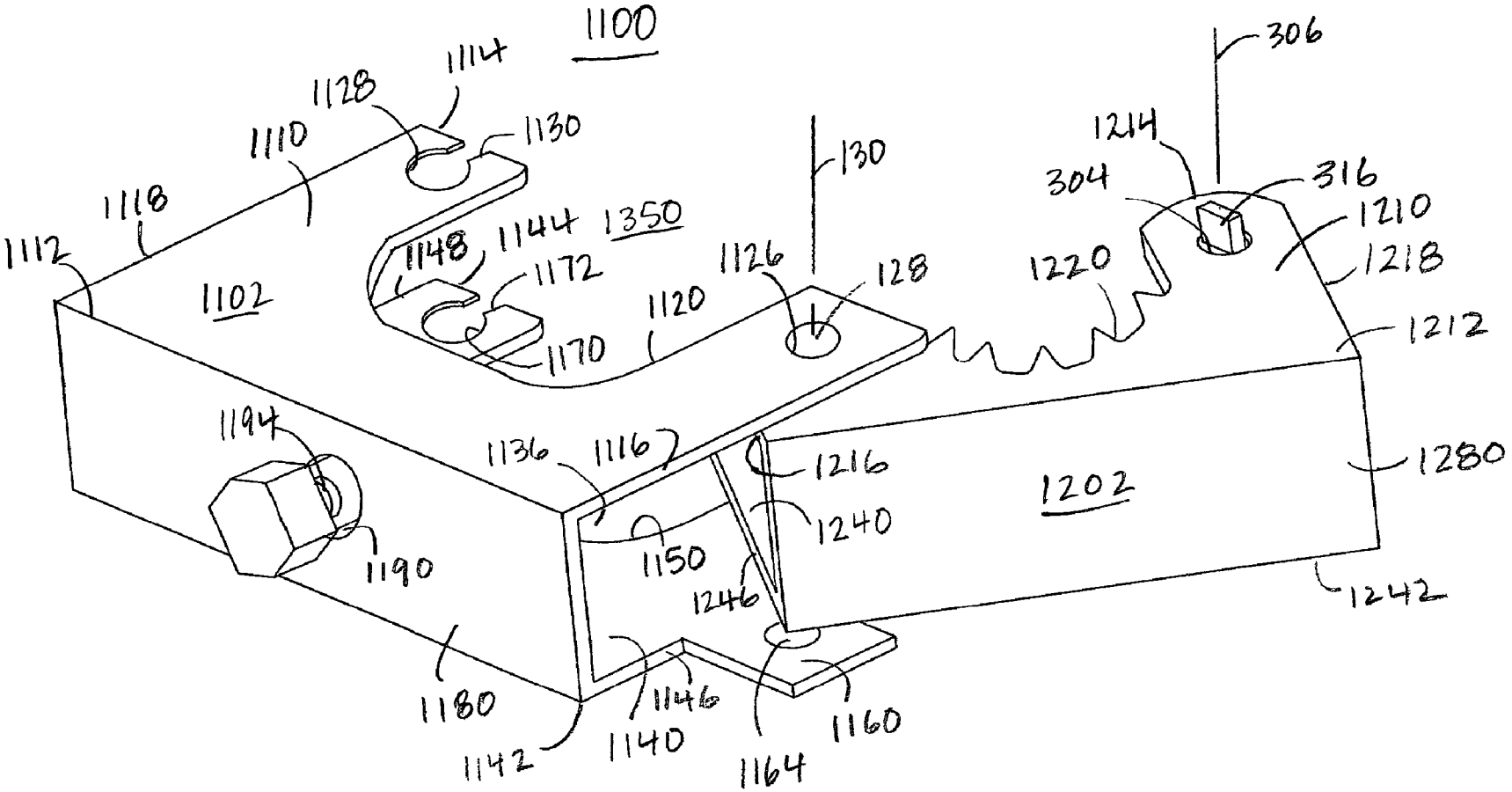
FIG. 9 is a perspective view of the hub assembly of FIG. 8 in an open configuration.
Figure 12:
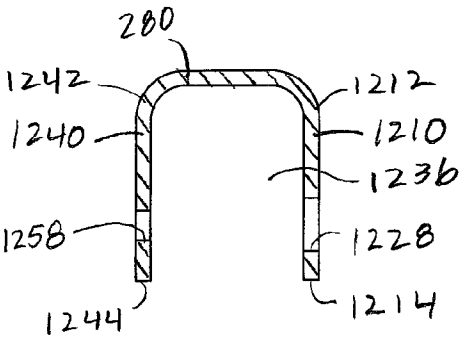
FIG. 12 is a side sectional view of the secondary support of FIG. 10 across line 12-12.
Figure 13:
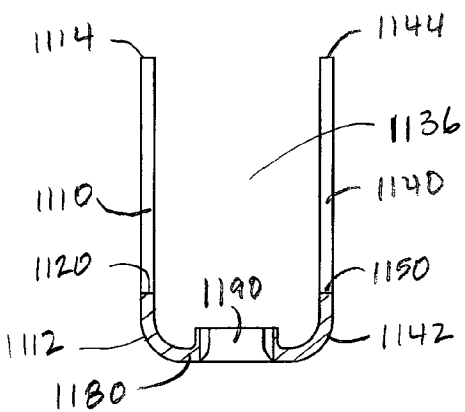
FIG. 13 is a side sectional view of the primary support of FIG. 11 across line 13-13.
Figure 10:
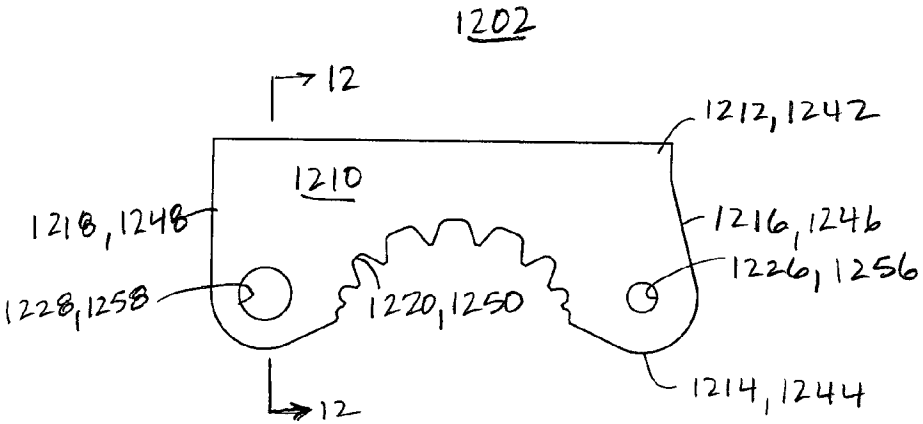
FIG. 10 is a top view of the secondary support of the hub assembly of FIG. 8.
Figure 11:
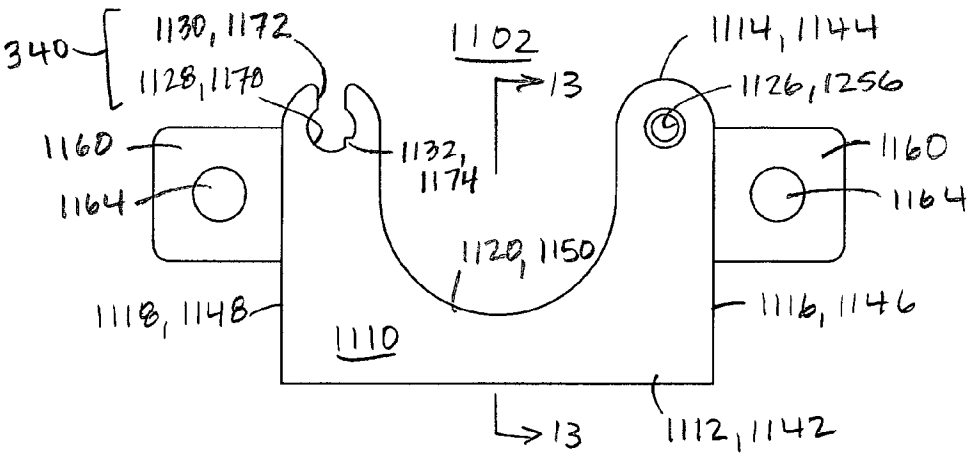
FIG. 11 is a top view of the primary support of the hub assembly of FIG. 8.

Referring particularly to FIG. 9, the hub assembly 1100 includes the locking mechanism 302 configured to detachably secure the primary support 1102 to the secondary support 1202. The structure and operation of the locking mechanism 302 is substantially the same as in the first embodiment. However, in the hub assembly 1100, the locking shaft 304 is rotatably supported by the secondary support 1202, rather than the primary support 1102. Accordingly, the first end 308 of the shaft 304 is supported in an opening 1228 provided in the third plate 1210 at a location between a third plate second lateral side edge 1218 and the third cut out 1220. An opposed second end 310 of the shaft 304 is supported in an opening 1258 provided in the fourth plate 1240 at a location between the fourth plate second lateral side edge 1248 and the fourth cut out 1250. The shaft 304 rotates relative to the third and fourth plates 1210, 1240 about its longitudinal axis 306, which is aligned generally perpendicular to the first and third plates 1110, 1210 and is retained within openings 1228, 1258 using e-clips.

In the hub assembly 1100, the catch 340 is provided on the primary support 1102 at a location which corresponds to the location of the shaft 304 on the secondary support 1202. That is, the catch 340 includes a first plate catch opening 1128 provided in the first plate 1110 at a location between the first plate second lateral side edge 1118 and the first plate cut out 1120, and a second plate catch opening 1170 provided in the second plate 1140 at a location between the second plate second lateral side edge 1148 and the second cut out 1150. Each catch opening 1128, 1170 is a generally circular opening disposed adjacent to and spaced apart from the corresponding free edge 1114, 1144. A slot 1130, 1172 extends between each catch opening 1128, 1170 and the corresponding free edge 1114, 1144. Each slot 1130, 1172 is open along the corresponding free edge 1114, 1144, and has a slot dimension parallel to the corresponding free edge 1114, 1144 that is less than the catch opening dimension parallel to the corresponding free edge 1114, 1144. Each slot 1130, 1172 provides a passage through which the keys 316, 234 may pass into the respective catch openings 1128, 1170 as the secondary support 1202 rotates to the closed position.

When the hub assembly 1100 is closed by rotating the secondary support 1202 about the pin 128 to position the keys 316, 324 within the corresponding catch openings 1128, 1170, the cut outs 1120, 1150 of the primary support 1102 cooperate together with the cut outs 1220, 1250 of the secondary support 1202 to define a generally circular hub opening 1350 configured to receive the sprinkler head fitting 20.

Independently of retaining the sprinkler head fitting 20 within the hub opening 1350 by closing the secondary support and turning the locking shaft keys 316, 324 to the second position, the adjustment bolts 1194 are used to secure the position of the sprinkler head fitting 20 within the hub opening 1350. In particular, when the sprinkler head fitting 20 is received within the hub opening 1350, the adjustment bolt 1194 is positioned within the through hole 1190 of the primary base 1180 so that an end of the bolt 194 abuts a surface of the sprinkler head fitting 20. The axial position of the bolt 1194 relative to the primary base 1180 can be adjusted by rotation of the bolt 194. Sufficient inward adjustment of the bolt 1194 urges the sprinkler head fitting 20 against the serrated edges of the cutouts 1220, 1250 of the secondary support 1202, and serves to secure the fitting within the hub assembly 100. Like the first embodiment, doing so also urges the keys 316, 324 to abut edge surfaces of the corresponding catch openings 1128, 1170, preventing rotation of the shaft 304 about the shaft axis 306, effectively preventing inadvertent release of the secondary support 1202 from the primary support 1102. On the other hand, sufficient reverse rotation of the bolt 1194 releases sprinkler head fitting 20 and permits opening of the hub assembly 1100.

A method of operating the hub assemblies 100, 1100 will now be described. Since operation of the hub assemblies 100, 1100 described herein is substantially similar, the method will be described with respect to the first embodiment hub assembly 100 in order to simplify the description.

In use, the hub assembly 100 is mounted on the corresponding sprinkler support assembly 16 within the ceiling frame 4. The hub assembly 100 is opened, so that the secondary support 202 is in an open position relative to the primary support 102.

When the hub assembly 100 is in an open position, the sprinkler head fitting 20 is inserted within the first and second cut outs 220, 250 of the primary support 102. Advantageously, the sprinkler head fitting 20 can be inserted while assembled together with the sprinkler head 18 and the flexible fluid supply conduit 22.

Once the sprinkler head fitting 20 is disposed within the first and second cut outs 220, 250, the secondary support 202 is rotated relative to the primary support 102 to the closed position, such that the cut outs 220, 250 of the secondary support 202 face the cut outs 220, 250 of the primary support forming the hub opening 350. In this configuration, the keys 316, 324 of the locking mechanism shaft 304 are disposed within the catch openings 228, 258.

To securely maintain the secondary support 202 in the closed position relative to the primary support, the locking mechanism shaft 304 is rotated to the second orientation in which the keys 316, 324 are prevented from passing through the slots 230, 260.

Although the general position of the sprinkler head fitting 20 within the ceiling is determined by the position of the hub assembly 100 on the support assembly 16, further adjustment of the fire sprinkler fitting within the hub assembly can be made, for example in a direction perpendicular to the first plate 110. The position of the sprinkler head fitting 20 relative to the hub assembly 100 is fixed by tightening the adjustment bolts 194. As discussed above, doing so urges the leg 50 against the sprinkler head fitting 20, which in turn is urged against the secondary support 202.

As discussed above, the hub assemblies 100, 1100 are used to mount flexible fire sprinkler fittings within a ceiling support structure 4. The particular hub assembly 100, 1100 used can depend on the features of the sprinkler head fitting 20, including the outer peripheral shape of the fire sprinkler fitting. For example, to accommodate a generally cylindrical sprinkler head fitting 20 which includes flat portions formed on the sides thereof, the first embodiment hub assembly 100 may be an appropriate selection since it includes cutouts 120, 150, 220, 250 having linear portions 122 which engage the flat surfaces of the fire sprinkler fitting. Alternatively, to accommodate a sprinkler head fitting 20 having a cylindrical peripheral shape (ie, without flat portions), the second embodiment hub assembly 1100, including toothed cutouts 1220, 1250 may be an appropriate selection due to its ability to grip the outer peripheral surface of the sprinkler head fitting 20.

As discussed above, the configuration of the hub assemblies is advantageous because a sprinkler head fitting that has been preassembled with the sprinkler head and flexible supply line can be easily installed in the hub opening. Once the sprinkler head fitting, including sprinkler head and flexible supply line attached thereto, is received within the hub assembly, the hub assembly is closed and locked. Because the sprinkler head fitting can be pre-assembled with the sprinkler head and flexible supply line, it can be pre-charged with water and tested prior to mounting within the ceiling, and also loaded into the open hub assembly in the assembled state. This feature also creates more flexibility in the construction process timelines, since the sprinkler system can be assembled and tested independently of ceiling construction.

Figure 14:
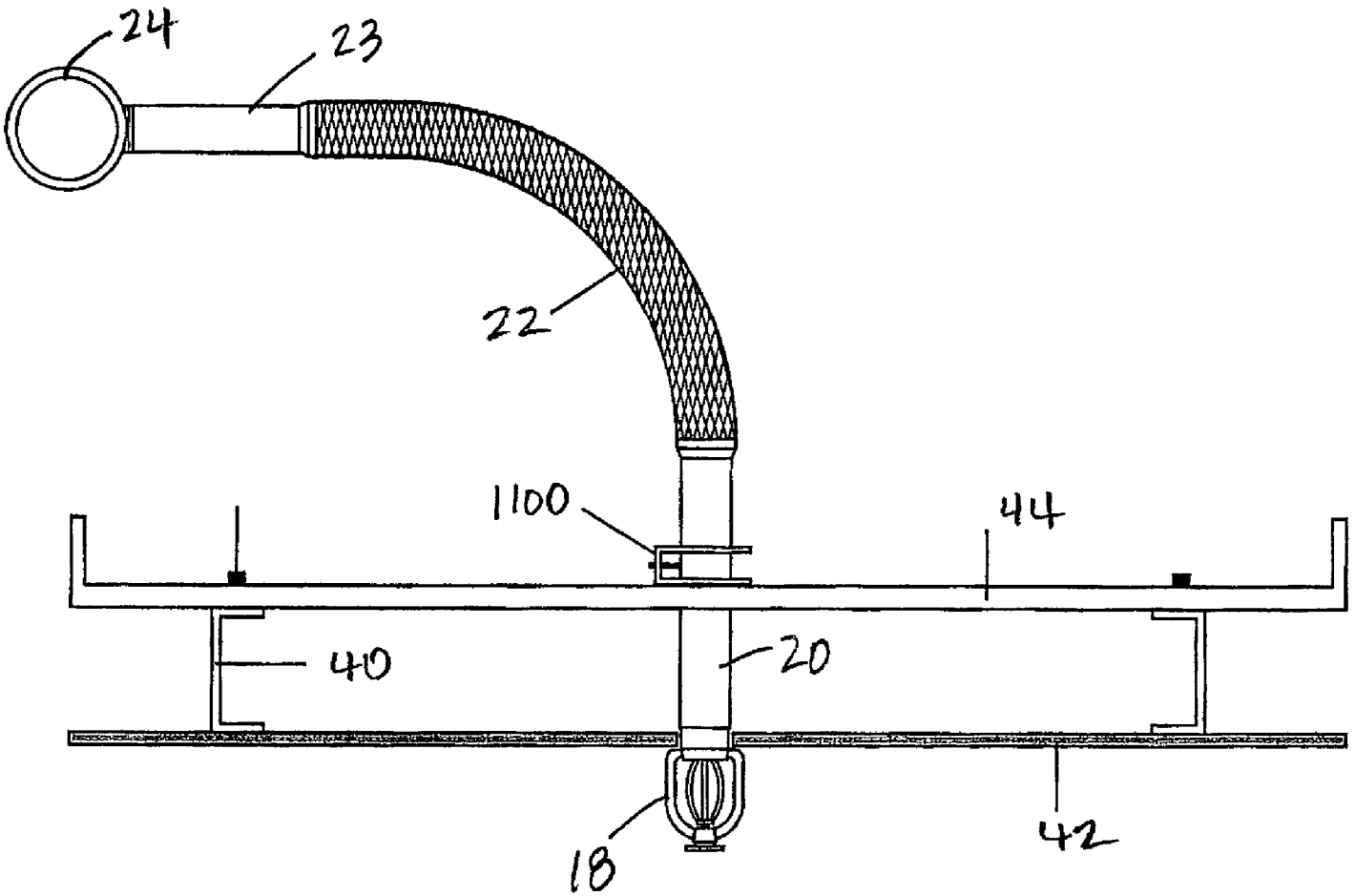
FIG. 14 is a sectional view of the hub assembly of FIG. 8 in use within an alternative ceiling system.

Referring to FIG. 14, although the hub assemblies 100, 1100 have been described herein with respect to a ceiling 2 formed of T-bar ceiling frame members 4, the hub assembly 100, 1100 is not limited to use with a T-bar-type suspended ceiling. For example, the ceiling frame may consist of wood studs, metal studs and rigid furring channel such as hat channel configured according to ASTM International standards. The standards may include, but are not limited to those set forth in designations C645-08a and C 754-07, which are each incorporated herein by reference. As seen in FIG. 14, a sheetrock ceiling 42 is supported by metal studs 40, which also support a hub assembly 1100 through a metal stud mounting bracket 44. The hub assembly 1100 maintains the sprinkler head 18 in a desired position relative to the sheet rock ceiling.

Although the hub assembly 100, 1100 has been described herein for use with a support assembly 16, 416 within a ceiling frame 4 of a suspended ceiling, the hub assembly is not limited to this application. For example, the hub assembly 100, 1100 can be suspended directly from a building structural member using a rigid rod.

Although the sprinkler system 14 is most commonly located above the ceiling frame 4, it can also reside in a floor or in one or more walls. For example, the hub assembly 1100 can be used to support a sprinkler head fitting 20 with in a floor or wall through a support assembly 16, 416 or by fixing the primary support 1102 directly to the floor or wall using the protrusions 1160.

A selected illustrative embodiment of the invention is described above in some detail. It should be understood that only structures considered necessary for clarifying the present invention have been described herein. Other conventional structures, and those of ancillary and auxiliary components of the system, are assumed to be known and understood by those skilled in the art. Moreover, while a working example of the present invention has been described above, the present invention is not limited to the working example described above, but various design alterations may be carried out without departing from the present invention as set forth in the claims.

We claim:

1. A hub assembly configured to support a flexible fire sprinkler fitting within a ceiling, the ceiling comprising a ceiling support structure, the hub assembly comprising:

a primary support configured to be mechanically coupled to the ceiling support structure and including a first plate, and a second plate extending generally parallel to and being spaced apart from the first plate, the first plate including a first plate base edge and a first plate free edge opposed to the first plate base edge, the first plate free edge having an first plate cut out along the first plate free edge, the first plate cut out having a shape that corresponds to a portion of a profile defined by the fitting, and first plate lateral side edges that extend between the first plate base edge and the first plate free edge, the second plate including a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out, second plate lateral side edges that extend between the second plate base edge and the second plate free edge, the primary support further comprising a primary base which extends between the first plate base edge and the second plate base edge;

a secondary support including a third plate, and a fourth plate extending generally parallel to and being spaced apart from the third plate, the third plate including a third plate base edge and a third plate free edge opposed to the third plate base edge, the third plate free edge having an third plate cut out along the third plate free edge, the third plate cut out having a shape that corresponds to a portion of a profile defined by the fitting, and third plate lateral side edges that extend between the third plate base edge and the third plate free edge, the fourth plate including a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out, fourth plate lateral side edges that extend between the fourth plate base edge and the fourth plate free edge, the secondary support further comprising a secondary base which extends between the third plate base edge and the fourth plate base edge;

the secondary support being rotatably connected to the primary support so as to rotate between an open position and a closed position about a first axis, the first axis being generally perpendicular to the first plate and intersecting the first plate between one first plate lateral side edge and the first plate cut out, a locking mechanism configured to detachably secure the primary support to the secondary support and including a shaft received in shaft openings provided on one of the primary and secondary supports at a location between the corresponding other lateral side edges and cut outs, a key protruding from the shaft in a direction generally perpendicular to the first plate, a catch configured to receive the key, the catch provided on the other of the primary and secondary supports at a location between the corresponding other lateral side edges and cut outs, the catch including catch openings formed in the corresponding plates of the other of the primary and secondary supports, and a slot extending from each catch opening to the corresponding free edge, the slot being open along the corresponding free edge at a location between the corresponding other lateral side edges and cut outs, the slot having a slot dimension parallel to the corresponding free edge that is less than the catch opening dimension parallel to the corresponding free edge, the shaft being rotatable about a shaft axis parallel to the first axis between a first orientation in which the key can pass through the slot, and a second orientation in which the key is prevented from being passed through the slot, and when the shaft is rotated to the second orientation while the key is positioned in the catch opening, the key is prevented from being withdrawn from the catch, and when the hub assembly is closed by positioning the key within the catch opening, the cut outs of the primary support cooperate together with the cut outs of the secondary support to define a hub opening configured to receive the fitting.

2. The hub assembly of claim 1, further comprising a bolt configured to secure the fitting within the hub assembly, the bolt being disposed in a bolt opening formed in the primary base.

3. The hub assembly of claim 1, wherein the key is rectangular, the key including a first key dimension transverse to the shaft axis that is less than the slot dimension, and a second key dimension transverse to both the first key dimension and the shaft axis, the second key dimension being greater than the slot dimension.

4. The hub assembly of claim 1, wherein the key is formed on a first end of the shaft so as to protrude along a longitudinal axis of the shaft, and a second key is formed on an opposed, second end of the shaft.

5. The hub assembly of claim 1, wherein a first end of the shaft is received in the shaft opening formed in one of the corresponding plates of the one of the primary and secondary supports, and a second end of the shaft is received in the shaft opening formed in the other of the corresponding plates of the one of the primary and secondary supports.

6. The hub assembly of claim 1, wherein at least one catch opening is defined by an inner edge, the inner edge including a protruding stop member.

7. The hub assembly of claim 1, wherein the first, second, third and fourth cut outs are configured to receive a flexible fire sprinkler fitting having a non-circular cross sectional shape.

8. The hub assembly of claim 1, wherein the first, second, third and fourth cut outs have a generally U shape.

9. The hub assembly of claim 1, wherein the first, second, third and fourth cut outs have a generally U shape including linear portions.

10. The hub assembly of claim 1, wherein the secondary support is rotatably connected to the primary support through a pin, the pin extending through the first, second, third and fourth plates.

11. The hub assembly of claim 1, wherein the ceiling support structure comprises T-bar arranged to form a grid.

12. The hub assembly of claim 1, wherein the ceiling support structure comprises parallel, spaced studs.

13. The hub assembly of claim 12, wherein the studs are formed of metal.

14. The hub assembly of claim 12, wherein the studs are formed of wood.

15. The hub assembly of claim 1, wherein the hub assembly further comprises the fitting disposed within the hub opening.

16. A fire sprinkler support assembly for supporting a flexible fire sprinkler fitting within a ceiling structure comprising parallel, spaced beams, the support assembly including a leg transverse to the beams, opposed ends of the leg connected to and supported on the beam via connection members, and the hub assembly of claim 1.

17. A fire protection sprinkler system comprising the support system of claim 16 and a flexible sprinkler assemblage, the flexible sprinkler assemblage including the flexible fire sprinkler fitting including a first end configured to connect to a flexible fluid supply line, and a second end configured to connect to a fire sprinkler head, and a flexible fluid supply line connected to the first end, wherein a portion of the flexible fire sprinkler fitting is disposed in the hub opening.

18. The fire protection system of claim 17 wherein the flexible fire sprinkler fitting has a circular cross sectional shape.

19. The fire protection system of claim 17 wherein the flexible fire sprinkler fitting has a generally circular cross sectional shape that includes a linear portion.

20. A support assembly configured to support a flexible fire sprinkler fitting within a ceiling structure comprising parallel, spaced beams, the support assembly including a leg transverse to the beams, opposed ends of the leg being connected to and supported by adjacent beams, and a hub assembly supported on the leg, the hub assembly comprising:

a primary support configured to be mechanically coupled to the ceiling support structure and including a first plate, and a second plate extending generally parallel to and being spaced apart from the first plate, the first plate including a first plate base edge and a first plate free edge opposed to the first plate base edge, the first plate free edge having an first plate cut out along the first plate free edge, the first plate cut out having a shape that corresponds to a portion of a profile defined by the fitting, and first plate lateral side edges that extend between the first plate base edge and the first plate free edge, the second plate including a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out, second plate lateral side edges that extend between the second plate base edge and the second plate free edge, the primary support further comprising a primary base which extends between the first plate base edge and the second plate base edge, the first plate, the primary base and the second plate defining a space in which the leg is received;

a secondary support including a third plate, and a fourth plate extending generally parallel to and being spaced apart from the third plate, the third plate including a third plate base edge and a third plate free edge opposed to the third plate base edge, the third plate free edge having an third plate cut out along the third plate free edge, the third plate cut out having a shape that corresponds to a portion of a profile defined by the fitting, and third plate lateral side edges that extend between the third plate base edge and the third plate free edge, the fourth plate including a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out, fourth plate lateral side edges that extend between the fourth plate base edge and the fourth plate free edge, the secondary support further comprising a secondary base which extends between the third plate base edge and the fourth plate base edge, the secondary support being rotatably connected to the primary support so as to rotate between an open position and a closed position about a first axis, the first axis being generally perpendicular to the first plate and intersecting the first plate between one first plate lateral side edge and the first plate cut out;

a locking mechanism configured to detachably secure the primary support to the secondary support and including a shaft received in shaft openings provided on the primary support at a location between the corresponding other lateral side edges and cut outs, a key protruding from the shaft in a direction generally perpendicular to the first plate, a catch configured to receive the key, the catch provided on the secondary support at a location between the corresponding other lateral side edges and cut outs, the catch including catch openings formed in the third and fourth plates, and a slot extending from each catch opening to the corresponding free edge, the slot being open along the corresponding free edge at a location between the corresponding other lateral side edges and cut outs, the slot having a slot dimension parallel to the corresponding free edge that is less than the catch opening dimension parallel to the corresponding free edge, the shaft being rotatable about a shaft axis parallel to the first axis between a first orientation in which the key can pass through the slot, and a second orientation in which the key is prevented from being passed through the slot, and when the shaft is rotated to the second orientation while the key is positioned in the catch opening, the key is prevented from being withdrawn from the catch, and when the hub assembly is closed by positioning the key within the catch opening, the cut outs of the primary support cooperate together with the cut outs of the secondary support to define a hub opening configured to receive the fitting.

21. The support assembly of claim 20 further comprising a bolt configured to adjustably position the hub assembly relative to the ceiling structure and to secure the fitting within the hub assembly, the bolt disposed in a bolt opening formed in the primary base, wherein the position of the bolt within the bolt opening is adjustable by rotating the bolt, and when the secondary support is closed such that the key is engaged by the catch and the fitting is disposed between the respective cutouts of primary and secondary supports, an end of the bolt urges the leg against the fitting to secure the fitting between the leg and the secondary support.

22. The support assembly of claim 21, wherein the bolt is configured to permit adjustment of the position of the hub assembly relative to the leg in a two orthogonal directions that are parallel to the first plate.

23. The support assembly of claim 20 wherein the key is rectangular, the key including a first key dimension transverse to the shaft axis that is less than the slot dimension, and a second key dimension transverse to both the first key dimension and the shaft axis, the second key dimension being greater than the slot dimension.

24. The support assembly of claim 20, wherein the key is formed on a first end of the shaft so as to protrude along a longitudinal axis of the shaft, and a second key is formed on an opposed, second end of the shaft.

25. The support assembly of claim 20, wherein a first end of the shaft is received in the shaft opening formed in the first plate, and a second end of the shaft is received in the shaft opening formed in the second plate.

26. The support assembly of claim 20, wherein at least one catch opening is defined by an edge, the edge including a protruding stop member.

27. The support assembly of claim 20, wherein the first, second, third and fourth cut outs are configured to receive a flexible fire sprinkler fitting having a non-circular cross sectional shape.

28. The support assembly of claim 20, wherein the first, second, third and fourth cut outs have a generally U shape.

29. The support assembly of claim 20, wherein the first, second, third and fourth cut outs have a generally U shape including linear portions.

30. The support assembly of claim 20, wherein the secondary support is rotatably connected to the primary support through a pin, the pin extending through the first, second, third and fourth plates.

31. The support assembly of claim 20, wherein the beams comprise T-bar arranged to form a grid.

32. The support assembly of claim 20, wherein the beams comprise metal studs.

33. The support assembly of claim 20, wherein the beams comprise wood studs.

34. The support assembly of claim 20, wherein a portion of each of the first and second plates is received between a portion of the each of the third and fourth plates.

35. A fire protection sprinkler system comprising the support system of claim 20 and a flexible sprinkler assemblage, the flexible sprinkler assemblage including the flexible fire sprinkler fitting including a first end configured to connect to a flexible fluid supply line, and a second end configured to connect to a fire sprinkler head, and a flexible fluid supply line connected to the first end, wherein a portion of the flexible fire sprinkler fitting is disposed in the hub opening.

36. A support assembly configured to support a flexible fire sprinkler fitting within a ceiling structure comprising parallel, spaced beams, the support assembly comprising a leg extending transverse to the beams, opposed ends of the leg being connected to and supported by adjacent beams, and a hub assembly supported on the leg, the hub assembly comprising:

a primary support configured to be mechanically coupled to the ceiling support structure and including a first plate, and a second plate extending generally parallel to and being spaced apart from the first plate, the first plate including a first plate base edge and a first plate free edge opposed to the first plate base edge, the first plate free edge having an first plate cut out along the first plate free edge, the first plate cut out having a shape that corresponds to a portion of a profile defined by the fitting, and first plate lateral side edges that extend between the first plate base edge and the first plate free edge, the second plate including a second plate base edge and a second plate free edge opposed to the second plate base edge, the second plate free edge having a second plate cut out along the second plate free edge, the second plate cut out having a shape that corresponds to a portion of a profile defined by the fitting, and being aligned with the first plate cut out, second plate lateral side edges that extend between the second plate base edge and the second plate free edge, the second plate lateral side edges further including protrusions extending outward beyond second plate lateral side edges in a plane parallel to the plane of the second plate, each protrusion including a through hole configured to receive a fastener for securing the second plate to the leg, the primary support further comprising a primary base which extends between the first plate base edge and the second plate base edge;

a secondary support including a third plate, and a fourth plate extending generally parallel to and being spaced apart from the third plate, the third plate including a third plate base edge and a third plate free edge opposed to the third plate base edge, the third plate free edge having an third plate cut out along the third plate free edge, the third plate cut out having a shape that corresponds to a portion of a profile defined by the fitting, and third plate lateral side edges that extend between the third plate base edge and the third plate free edge, the fourth plate including a fourth plate base edge and a fourth plate free edge opposed to the fourth plate base edge, the fourth plate free edge having a fourth plate cut out along the fourth plate free edge, the fourth plate cut out having a shape that corresponds to a portion of a profile defined by the fitting, and being aligned with the third plate cut out, fourth plate lateral side edges that extend between the fourth plate base edge and the fourth plate free edge, the secondary support further comprising a secondary base which extends between the third plate base edge and the fourth plate base edge;

the secondary support being rotatably connected to the primary support so as to rotate between an open position and a closed position about a first axis, the first axis being generally perpendicular to the first plate and intersecting the first plate between one first plate lateral side edge and the first plate cut out, a locking mechanism configured to detachably secure the primary support to the secondary support and including a shaft received in shaft openings provided on the secondary support at a location between the corresponding other lateral side edges and cut outs, a key protruding from the shaft in a direction generally perpendicular to the first plate, a catch configured to receive the key, the catch provided on the primary support at a location between the corresponding other lateral side edges and cut outs, the catch including catch openings formed in the first and second plates, and a slot extending from each catch opening to the corresponding free edge, the slot being open along the corresponding free edge at a location between the corresponding other lateral edges and cut outs, the slot having a slot dimension parallel to the corresponding free edge that is less than the catch opening dimension parallel to the corresponding free edge, the shaft being rotatable about a shaft axis parallel to the first axis between a first orientation in which the key can pass through the slot, and a second orientation in which the key is prevented from being passed through the slot, and when the shaft is rotated to the second orientation while the key is positioned in the catch opening, the key is prevented from being withdrawn from the catch, and when the hub assembly is closed by positioning the key within the catch opening, the cut outs of the primary support cooperate together with the cut outs of the secondary support to define a hub opening configured to receive the fire sprinkler fitting.

37. The support assembly of claim 36 further including a bolt configured to secure the fitting within the hub assembly, the bolt being disposed in a bolt opening formed in the primary base, wherein the position of the bolt within the bolt opening is adjustable by rotating the bolt, and when the secondary support is positioned relative to the primary support such that the key is engaged by the catch and the fitting is disposed between the respective cutouts of primary and secondary supports, an end of the bolt urges the fitting against the secondary support to secure the fitting within the hub assembly.

38. The support assembly of claim 36, wherein the key is rectangular, the key including a first key dimension transverse to the shaft axis that is less than the slot dimension, and a second key dimension transverse to both the first key dimension and the shaft axis, the second key dimension being greater than the slot dimension.

39. The support assembly of claim 36, wherein the key is formed on a first end of the shaft so as to protrude along a longitudinal axis of the shaft, and a second key is formed on an opposed, second end of the shaft.

40. The support assembly of claim 36, wherein a first end of the shaft is received in the shaft opening formed in the third plate, and a second end of the shaft is received in the shaft opening formed in the fourth plate.

41. The support assembly of claim 36, wherein at least one catch opening is defined by an inner edge, the inner edge including a protruding stop member.

42. The support assembly of claim 36, wherein the first, second, third and fourth cut outs are configured to receive a flexible fire sprinkler fitting having a circular cross sectional shape.

43. The support assembly of claim 36, wherein the first, second, third and fourth cut outs have a generally U shape.

44. The support assembly of claim 36, wherein the third and fourth cut outs have a serrated edge.

45. The support assembly of claim 36, wherein the secondary support is rotatably connected to the primary support through a pin, the pin extending through the first, second third and fourth plates.

46. The support assembly of claim 36, wherein the beams comprise T-bar arranged to form a grid.

47. The support assembly of claim 36, wherein the beams comprise metal studs.

48. The support assembly of claim 36, wherein the beams comprise wood studs.

49. The support assembly of claim 36, wherein a portion of each of the third and fourth plates is received between a portion of each of the first and second plates.

50. A fire protection sprinkler system comprising the support system of claim 36 and a flexible sprinkler assemblage, the flexible sprinkler assemblage including the flexible fire sprinkler fitting including a first end configured to connect to a flexible fluid supply line, and a second end configured to connect to a fire sprinkler head, and a flexible fluid supply line connected to the first end, wherein a portion of the flexible fire sprinkler fitting is disposed in the hub opening.

* * * * *